US007267118B2

(12) United States Patent
Eddins et al.

(10) Patent No.: US 7,267,118 B2
(45) Date of Patent: Sep. 11, 2007

(54) TOY SYSTEM WITH DETACHABLE WEAPONS

(75) Inventors: Fred D. Eddins, Mapleville, RI (US); Robert L. Brown, North Kingstown, RI (US)

(73) Assignee: Hasbro, Inc., Pawtucket, RI (US)

( * ) Notice: Subject to any disclaimer, the term of this patent is extended or adjusted under 35 U.S.C. 154(b) by 353 days.

(21) Appl. No.: 10/945,350

(22) Filed: Sep. 20, 2004

(65) Prior Publication Data

US 2005/0183708 A1 Aug. 25, 2005

Related U.S. Application Data

(63) Continuation-in-part of application No. 10/775,427, filed on Feb. 10, 2004, now Pat. No. 7,185,787.

(51) Int. Cl.
*F41B 11/00* (2006.01)

(52) U.S. Cl. ..... 124/63; 124/59

(58) Field of Classification Search ..... 124/59, 124/60, 61, 63, 64, 65, 66, 67, 68, 69; 222/79
See application file for complete search history.

(56) References Cited

U.S. PATENT DOCUMENTS

| | | | | |
|---|---|---|---|---|
| 3,878,639 | A | | 4/1975 | Scheelar et al. |
| 4,854,480 | A | | 8/1989 | Shindo |
| 5,018,449 | A | | 5/1991 | Eidson, II |
| 5,074,437 | A | | 12/1991 | D'Andrade et al. |
| 5,240,450 | A | | 8/1993 | Graham |
| 5,305,919 | A | | 4/1994 | Johnson et al. |
| 5,354,225 | A | | 10/1994 | Hix |
| 5,377,655 | A | * | 1/1995 | Arad ..... 124/65 |
| 5,433,646 | A | | 7/1995 | Tarng |
| 5,515,837 | A | | 5/1996 | Nin et al. |
| 5,529,525 | A | | 6/1996 | Deal |
| 5,531,627 | A | | 7/1996 | Deal |
| 5,538,457 | A | | 7/1996 | Deal |
| 5,592,931 | A | * | 1/1997 | Johnson et al. ..... 124/69 |
| 5,715,802 | A | * | 2/1998 | Moore et al. ..... 124/66 |
| 6,193,107 | B1 | | 2/2001 | D'Andrade |
| 6,279,562 | B1 | | 8/2001 | Clayton |
| 6,631,830 | B2 | | 10/2003 | Ma et al. |

* cited by examiner

*Primary Examiner*—Michael J. Carone
*Assistant Examiner*—Gabriel J. Klein
(74) *Attorney, Agent, or Firm*—Marshall, Gerstein & Borun LLP

(57) ABSTRACT

A toy gun system for launching foam projectiles includes a primary gun having a pneumatic system, a launch station in flow communication with the pneumatic system, and first, second and third triggers, with the primary gun adapted to launch a projectile from the launch station in response to actuation of the first trigger. The primary gun includes first and second receiving areas, each with plungers or actuators responsive to trigger movement, with the first receiving area having an output port and valve in flow communication with the pneumatic system. A first detachable gun is sized for mounting to the first receiving area and has a pneumatic system arranged to receive pressurized air from the primary gun, and a second detachable gun is sized for mounting at the second receiving area. Each of the first and second detachable guns may be operated while attached to the primary gun, and may be selectively removable from the primary gun for use.

23 Claims, 29 Drawing Sheets

TOY SYSTEM WITH DETACHABLE WEAPONS

RELATED APPLICATIONS

This application is a continuation-in-part of earlier U.S. non-provisional application Ser. No. 10/775,427, filed Feb. 10, 2004, now U.S. Pat. No. 7,185,787 the entire disclosure of which is incorporated herein by reference.

BACKGROUND OF THE INVENTION

The present invention relates generally to toy guns and, more particularly, to a pressurized toy gun having a primary gun and one or more detachable toy guns.

Toy projectile launchers that eject toy projectiles with a burst of pressurized air are generally known in the art. For example, U.S. Pat. No. 5,724,954 to Smith discloses a projectile launcher having a housing, a projectile launch tube slidably joined to the housing for movement between a first position and a second position, a launch tube spring biasing the launch tube towards the first position and a piston slidably disposed in the housing for movement from an un-cocked position to a cocked position in response to the launch tube moving from the first position to the second position. The launch tube includes a first portion for releasably mounting a projectile and a hollow second portion in fluid communication with the first portion, with the piston moving from the cocked position to the un-cocked position to compress fluid in the second portion of the launch tube. The projectile launcher further includes a piston spring biasing the piston toward the un-cocked position, a sear slidably joined to the housing for releasably retaining the piston in the cocked position, and a release means for sliding the sear to release the piston from the cocked position.

U.S. Pat. No. 5,791,326 to Brown et al., discloses a toy projectile launcher having a housing, a cylinder fixed to the housing and defining an inner bore, a projectile launch tube slidably disposed in the cylinder for movement from a cocked position to an un-cocked position to compress gas in the cylinder, and a projectile holder in fluid communication with the cylinder to releasably mount a projectile to be launched. The toy projectile launcher further includes a seal fixed to the projectile launch tube and in sealing engagement with the cylinder inner bore, a sear for releasably engaging the projectile launch tube in the cocked position, biasing means for returning the projectile launch tube to the un-cocked position, and a trigger for engaging the sear to release the projectile launch tube from the cocked position and emit compressed gas to the projectile holder.

SUMMARY OF THE INVENTION

In one aspect, a toy gun system for launching projectiles comprises a primary gun having a pneumatic system, a launch station in flow communication with the pneumatic system, and first, second and third triggers, with the primary gun adapted to launch a projectile from the launch station in response to actuation of the first trigger. The primary gun includes a first receiving area having an output port and a valve in flow communication with the pneumatic system, and includes a first shiftable actuator responsive to movement of the second trigger. The primary gun further includes a second receiving area having a second shiftable actuator responsive to movement of the third trigger, and a first detachable pneumatic gun having a launch station is sized for mounting to the first receiving area and is arranged to receive pressurized air from the pneumatic system of the primary gun via a port adjacent the first receiving area, and further is adapted to launch a projectile in response to operation of the second trigger when the first detachable gun is disposed in the first receiving area. A second detachable gun is sized for mounting to the second receiving area and includes a launching system adapted to launch a projectile from a launch station in response to operation of the third trigger. The first and second detachable guns are selectively removable from the first gun for use.

In further accordance with the disclosed example, the first detachable gun includes a main trigger and is operable using either of the second trigger or the main trigger. Similarly, the second detachable gun includes a main trigger, and the second detachable gun is operable using either of the third trigger or the main trigger. Preferably, the first receiving area includes a spring-loaded plunger positioned to releasably retain the first detachable gun in the first receiving area.

The first conduit includes a valve shiftable between an open position when the first detachable gun is disposed in the first receiving area to permit flow communication between the pneumatic system of the primary gun and the pneumatic system of the first detachable gun, the valve shiftable to a closed position in response to removing the first detachable gun from the first receiving area. The primary gun includes a track and a portion of the second detachable gun is sized to engage the track.

The second detachable gun preferably includes a spring-loaded plunger operably coupled to a housing, and the plunger is shiftable between an uncocked position and a cocked position in response to shifting the housing relative to the body of the second detachable gun. Preferably, the pneumatic systems of each of the primary gun and the first detachable gun includes a pump, and the pneumatic system of the second detachable gun is arranged to be pressurized using the pump of the primary gun or the pump of the first detachable gun. Still preferably, the first detachable gun includes a plurality of launch stations, and the first detachable gun is operable in a first mode in which only a single launch station is actuated at a time, the first detachable gun further operable in a second mode in which more than one of the launch stations are actuated at once.

In accordance with another aspect of the invention, a toy gun system comprises a primary gun having a pneumatic system including a reservoir, a launch station in flow communication with the reservoir, a plurality of actuating triggers, and a valve operatively associated with the launch station and responsive to actuation of a first one of the triggers, with the primary gun adapted to launch a projectile from the launch station in response to actuation of the first trigger. The primary gun further includes at least one receiving area having an output port and a valve in flow communication with the pneumatic system, the receiving area positioned on the primary gun adjacent a first shiftable actuator responsive to movement of a second one of the triggers. A first detachable gun includes a launch station and is sized for mounting at the first receiving area, the first detachable gun having a pneumatic system arranged for flow communication with the pneumatic system of the primary gun via the output port when the first detachable gun is disposed in the receiving area, with the first detachable gun adapted to launch a projectile from the launch station by actuating the second trigger when the first detachable gun is disposed in the first receiving area or by actuating a main trigger on the first detachable gun.

In accordance with yet another aspect in the invention, a toy gun system comprises a primary toy gun having a pressurizable reservoir, a launch station in flow communication with the reservoir, an actuating trigger, and an actuator arranged to release pressure from the reservoir through the launch station, the launch station adapted to hold and release a foam projectile in response to actuation of the actuator. The primary toy gun further includes a receiving area, the receiving area having an output port in flow communication with the reservoir. A valve is positioned to control flow between the primary gun and a detachable gun, and the detachable toy gun is removably attached to the first receiving area. The detachable toy gun includes a pressurizable reservoir, a launch station in flow communication with the reservoir, and an actuator arranged to release pressure from the reservoir through the launch station. The launch station is adapted to hold and release a foam projectile in response to actuation of the actuator, and the detachable toy includes an input port arranged to route pressure from the output port of the receiving are to the reservoir of the detachable toy gun. The detachable toy is selectively operable to launch the foam projectile when the detachable toy is in the receiving area and when the detachable toy is removed from the receiving area.

DETAILED DESCRIPTION OF VARIOUS EMBODIMENTS

Although the following text sets forth a detailed description of an exemplary embodiment of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. § 112, sixth paragraph.

Figure 1:
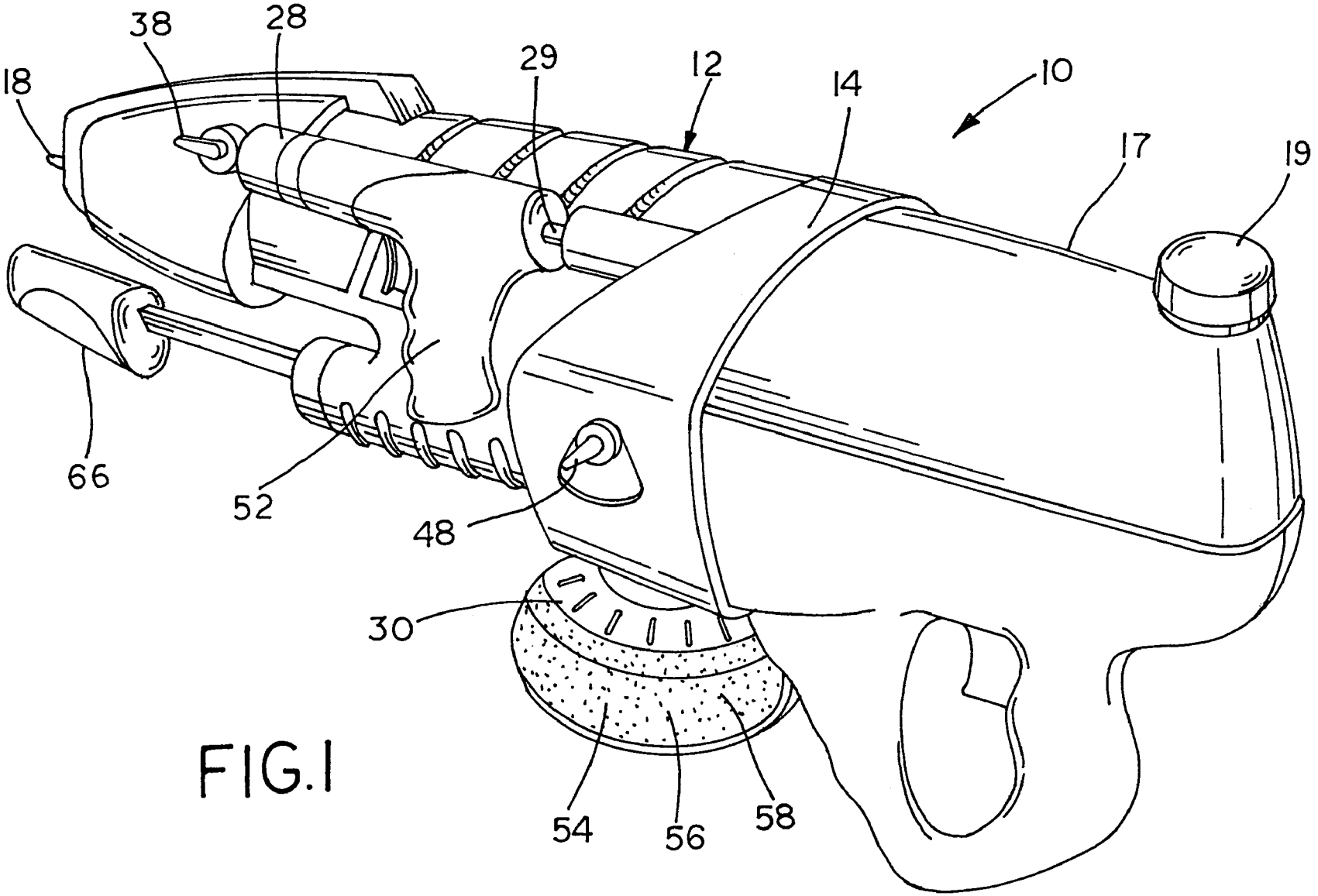
FIG. 1 is a perspective view of a toy water gun system assembled in accordance with the teachings of the present invention.
Figure 2A:
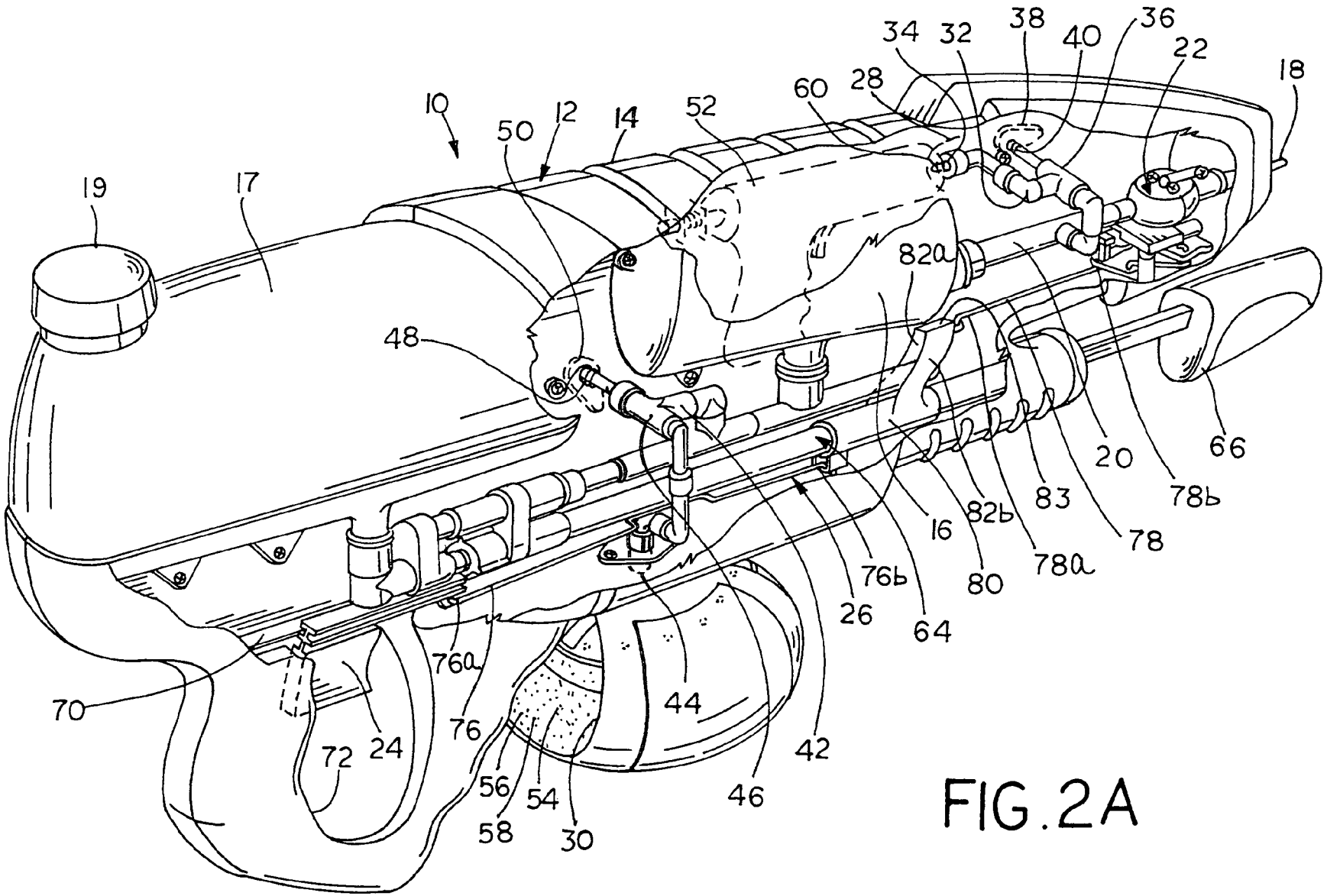
FIG. 2A is a partial cut away view in perspective of the toy water gun system of FIG. 1.
Figure 2B:
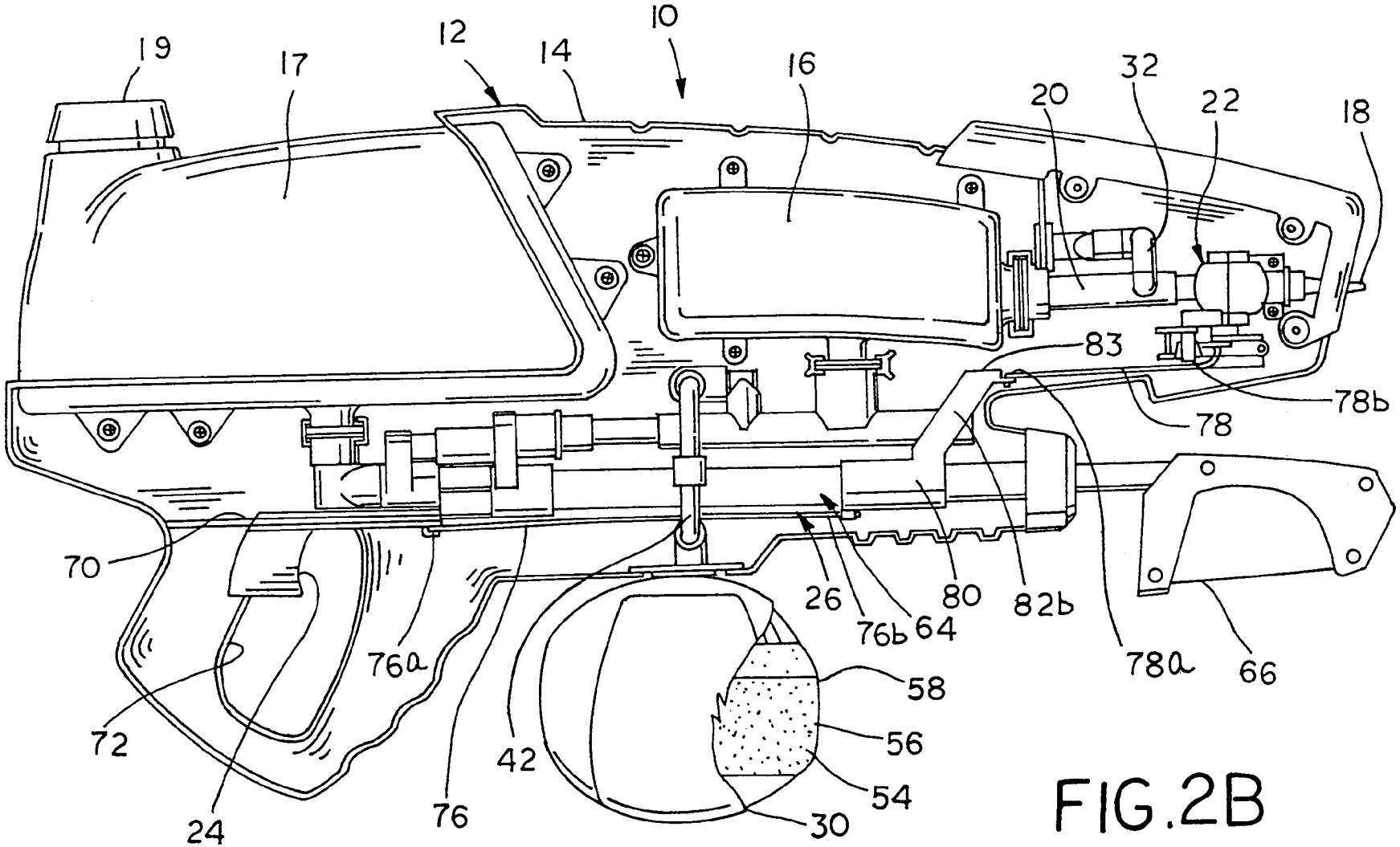
FIG. 2B is a partial cut away elevational view of the toy water gun system shown in FIGS. 1 and 2A.

Referring now to FIGS. 1, 2A and 2B of the drawings, a toy water gun system assembled in accordance with the teachings of the present invention is shown and is generally referred to by the reference numeral 10. The toy water gun system 10 includes a primary water gun 12 having a housing 14 and a reservoir 16 disposed within or otherwise attached or mounted to the housing 14. The reservoir 16 is visible in FIGS. 2A and 2B. Alternatively, the housing 14 may take the form of a frame, or any other suitable structure. The reservoir 16, in accordance with the disclosed example, is preferably pressurizable as will be explained in greater detail below. Also, the primary water gun may include a separate reservoir 17 operatively connected to the reservoir 16 via a system of conduits or other suitable connections as will be described in greater detail below. The reservoir 17 includes a fill cap 19, which is preferably removable to permit filling of the toy gun 12. Other suitable systems of the type known in the art for filling the toy gun may be used, such as those systems that permit the toy gun 12 to be filled by connection to a garden hose.

As shown in FIGS. 2A and 2B, the primary water gun includes an outlet nozzle 18 in flow communication with the reservoir 16 via a conduit 20. A valve assembly 22 is disposed adjacent the outlet nozzle 18 and is operatively connected to a trigger 24 via a linkage 26. As will be explained in greater detail below, when the reservoir 16 is pressurized the primary water gun 12 will eject or shoot a stream of water the from the outlet nozzle 18 in response to operation of the trigger 24.

Referring to FIGS. 1 and 2A, the housing 14 includes a first receiving area 28 and a second receiving area 30. As shown in FIG. 2A, the first receiving area 28 is in flow communication with the reservoir 16 via a conduit 32. The conduit 32 includes an output port 34, and a valve 36 having a switch or handle 38. The valve 36 may be a rotary valve or any other suitable valve. Preferably, a rotary spring 40 is provided adjacent the handle 38 in order to maintain the valve 36 in a closed position.

Similarly, the second receiving area 30 is in flow communication with the reservoir 16 via a conduit 42. The conduit 42 includes an output port 44, and a valve 46 having a switch or handle 48. Again, the valve 46 may be a rotary valve or any other suitable valve. Preferably, a rotary spring 50 is provided adjacent to the handle 48 in order to maintain the valve 46 in a closed position. It will be understood that, upon operation of the valve 36 using the handle 38, that output port 34 may be placed in flow communication with the reservoir 16 via the conduit 32. Similarly, it will be understood that upon operation of the valve 46 using the handle 48, that the output port 44 may be placed in flow communication with the reservoir 16 via the conduit 42.

The toy water gun system 10 further includes a first detachable water toy 52 and a second detachable water toy 54. The first detachable water toy 52, in accordance with the disclosed example, takes the form of a water pistol. The water toy 52 is preferably sized to be releasably mounted to the first receiving area 28 of the primary water gun 12. Similarly, the water toy 54 is preferably sized to be releasably mounted to the second receiving area 30 of the primary water gun 12. The second water toy 54, in accordance with the disclosed example, preferably is constructed of an absorbent material, such as a sponge 56 covered by a water permeable cover 58. Alternatively, both water toys 52 and 54 may be water pistols, both may be absorbent sponges, or one or both may take the form of any other suitable water toy.

The first water toy 52 includes a nozzle 60 (best visible in FIGS. 2A, 5 and 11-12) and an internal reservoir 62 (FIGS. 11 and 12) in flow communication with the nozzle 60. As shown in FIG. 2A, when the water toy 52 is disposed in the first receiving area 28, the nozzle 60 is positioned for flow communication with the output port 34 of the first receiving area 28. Similarly, when the second water toy 54 is disposed in the second receiving area 30, the second water toy (i.e., the sponge 56), is positioned so as to be in flow communication with, or otherwise exposed to, the output port 44 of the second receiving area 30.

Referring to FIGS. 2A and 2B, the reservoir 16 of the primary water gun 12 may be a pressurized toy water squirt gun having a self-contained pressurizing mechanism 64 for pressurizing the reservoir 16 with air, thereby creating a pressure differential between the reservoir 16 and the ambient atmosphere so that water contained in the reservoir 16 may be propelled from the primary toy water gun 12 through the outlet nozzle 18 when the user pulls the trigger 24. The pressurizing mechanism 64 includes a reciprocating pump handle 66, a pair of one way valves 67 and 69, and an over pressure valve 71. As will be explained in greater detail below, in response to operation of the pressurizing mechanism 64 using the handle 66, water contained in the reservoir 17 will be transferred into the reservoir 16. One example of a toy water gun having a pressurizing mechanism for propelling water from a pressurizeable reservoir is illustrated and described in U.S. Pat. No. 5,305,919, entitled "Pinch Trigger Hand Pump Water Gun with Non-Detachable Tank," which issued on Apr. 26, 1994, and which is hereby expressly incorporated by reference herein in its entirety. Of course, other configurations of toy water guns having pressurizing mechanisms for propelling water are well known and will be understood by those skilled in the art.

Referring still to FIGS. 2A and 2B, the valve assembly 22 is disposed within the housing 14 generally adjacent to a forward end 68 of the primary water gun 12. The trigger 24 is preferably slidable on a track 70 disposed within a trigger guard 72 generally adjacent to a rearward end 74 of the primary water gun 12. A portion of the trigger guard 72 may also form a handle for gripping the primary water gun 12, with another handle preferably being provided toward a forward portion of the gun at any suitable location. Instead of a reciprocating trigger, the trigger 24 may be a pivoting trigger or any other trigger suitable for activating the valve assembly 22. The linkage 26 includes a first rod 76 connected to a forward end of the trigger 24, a second rod 78 connected to the valve assembly 22, and a sliding tube 80 operatively connecting the first rod 76 to the second rod 78. The linkage 26 may join the trigger 24 to the valve assembly 22 in any other suitable manner. In the disclosed example, the sliding tube 80 fits over one of the internal conduits of the pressurizing mechanism 64 so as to guide the sliding tube 80 along a generally linear path in response to operation of the trigger 24. In the disclosed example, the tube 80 includes a pair of spaced apart extensions 82*a* and 82*b* which meet at a top end 83. A rear end 78*a* of the rod 78 is attached to the top end 83 of the tube 80. In the disclosed example, the tube 80 straddles another one of the internal conduits, such that the tube 80 slides back and forth without interference from the internal components of the primary water gun 12. Accordingly, operation of the trigger 24 is translated into generally linear movement of the rods 76 and 78 and the tube 80, such that the valve assembly 22 is actuated in response to actuating the trigger 24.

Figure 3:
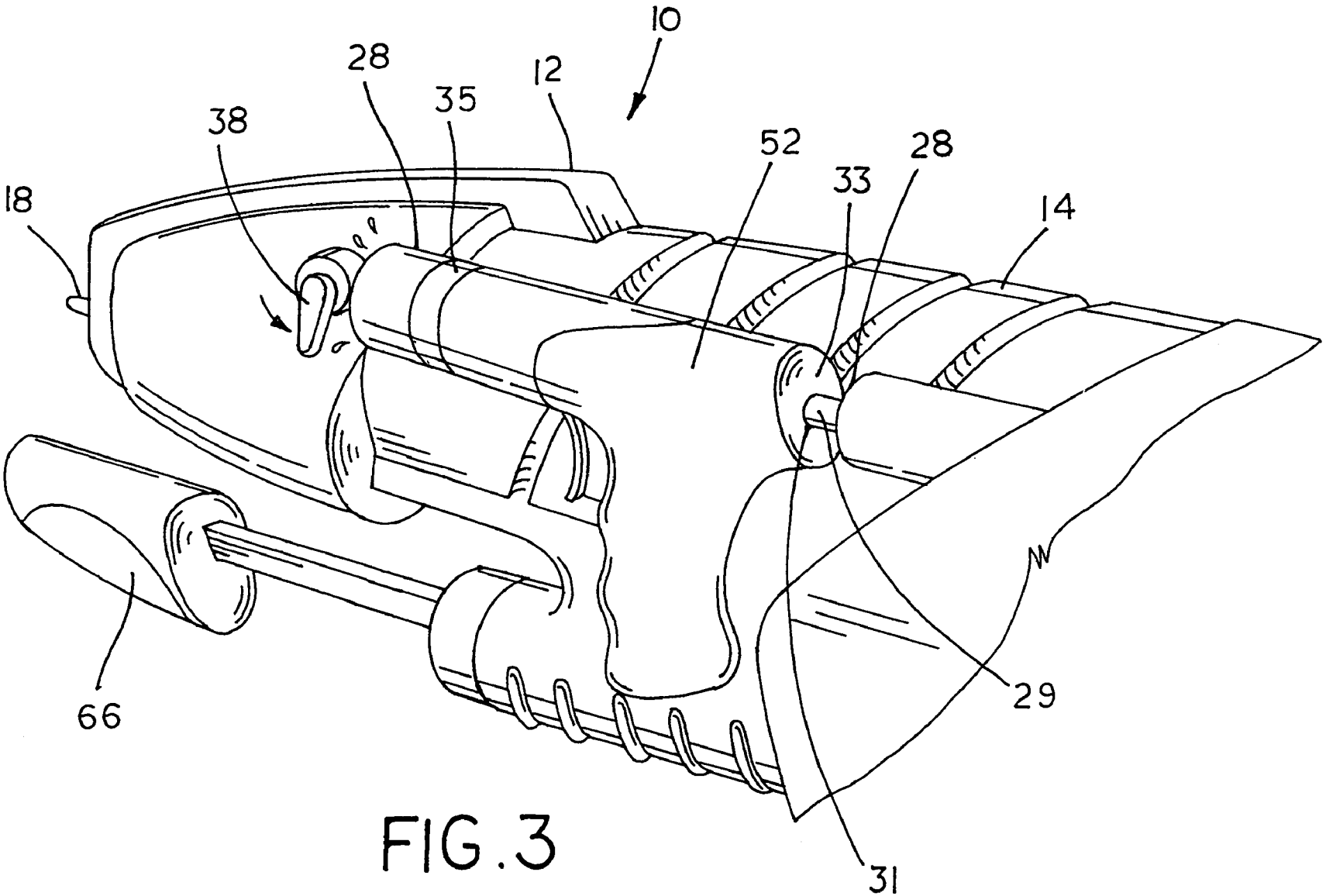
FIG. 3 is an enlarged fragmentary view in perspective of a forward portion of the primary water toy and illustrating a first detachable water toy.
Figure 4:
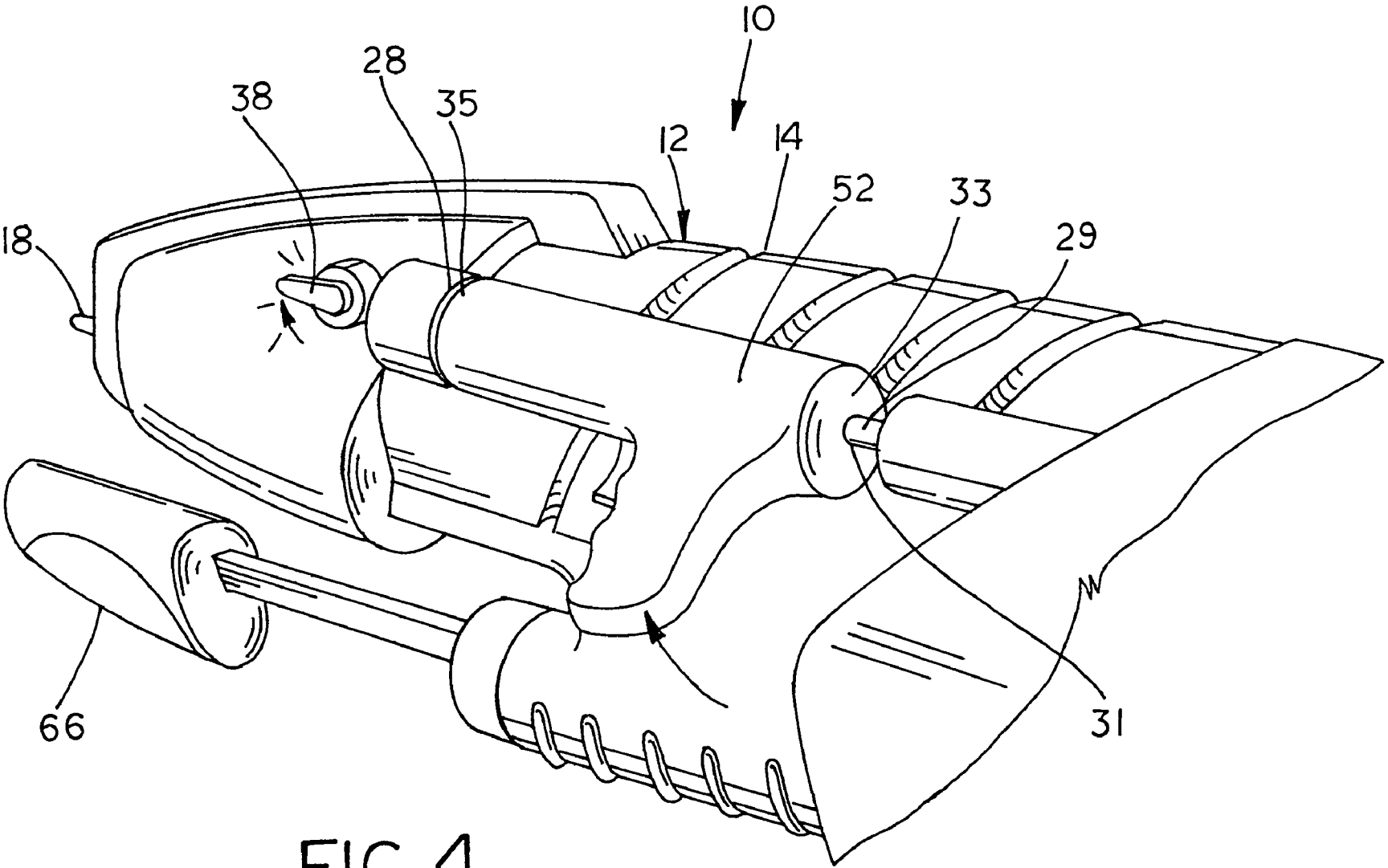
FIG. 4 is an enlarged fragmentary view in perspective similar to FIG. 3 and showing a spring-loaded plunger disposed within a portion of the housing.
Figure 5:
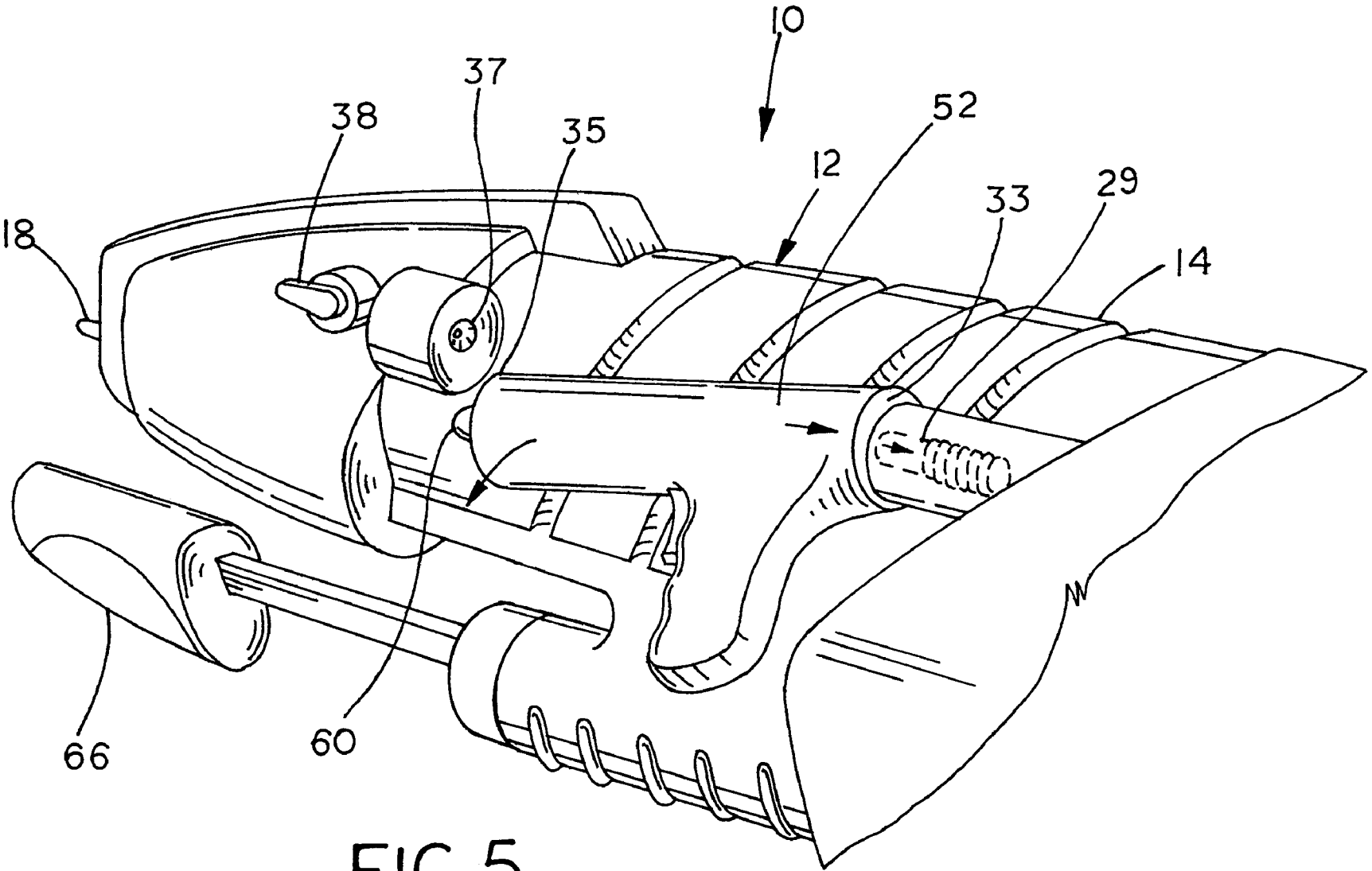
FIG. 5 is an enlarged fragmentary view in perspective similar to FIG. 4 and illustrating one possible manner by which the first detachable water toy may be removed from the primary water toy.
Figure 15:
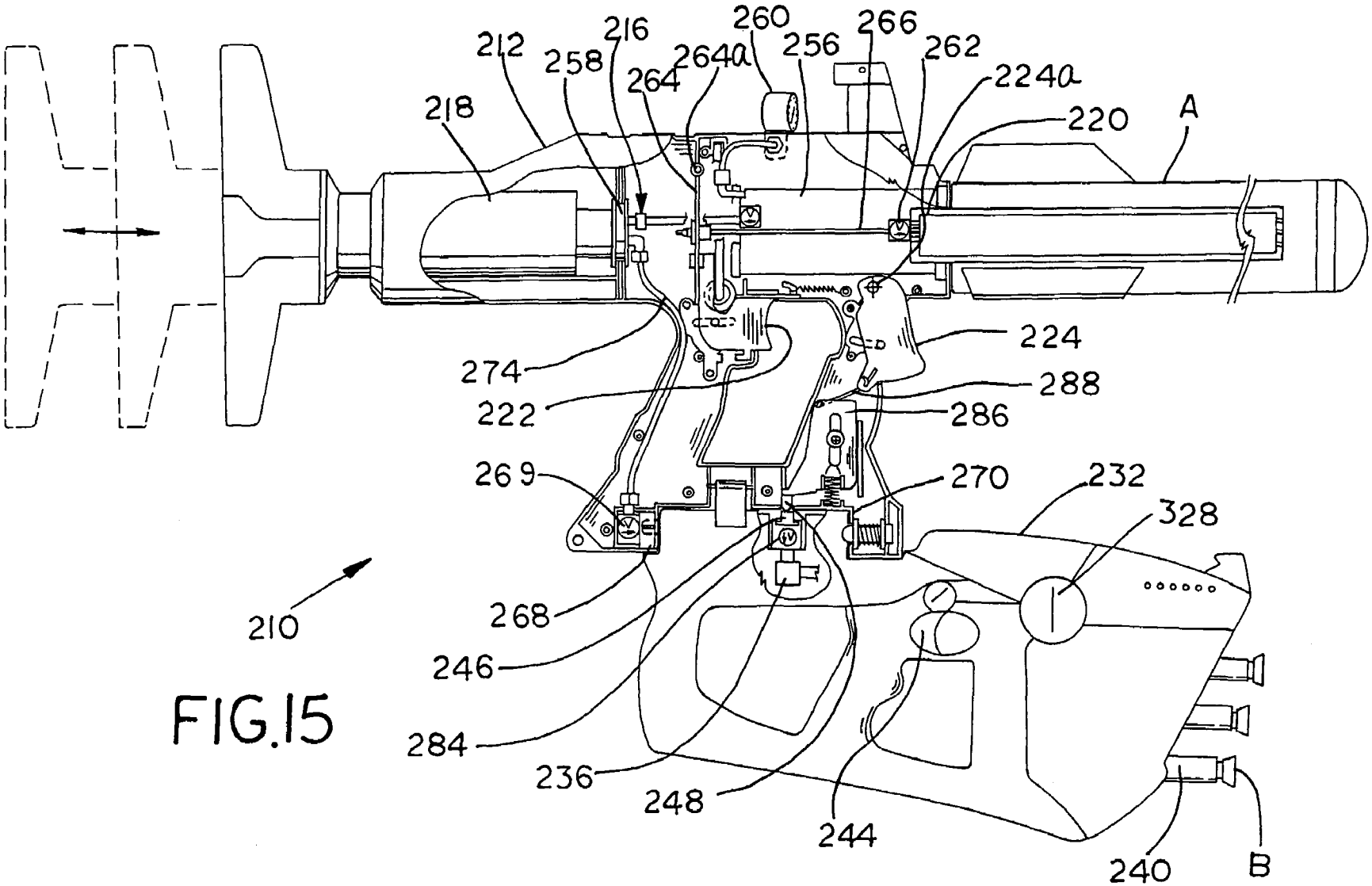
FIG. 15 is an enlarged fragmentary view, partly in section, of the toy gun system of FIG. 14.

Referring now to FIGS. 3-5, the first water toy 52 is shown disposed in the first receiving area 28. The first receiving area 28 preferably includes a spring-loaded plunger 29 which engages a recess 31 defined in a rearward part 33 of the first water toy 52. As can be seen in FIG. 15, a forward part 35 of the first water toy 52 and/or a tip of the water toy 52 is preferably shaped to be received in a recess 37 defined in the first receiving area 28 generally surrounding or otherwise adjacent to the output port 34 of the first receiving area 28.

Figure 6:
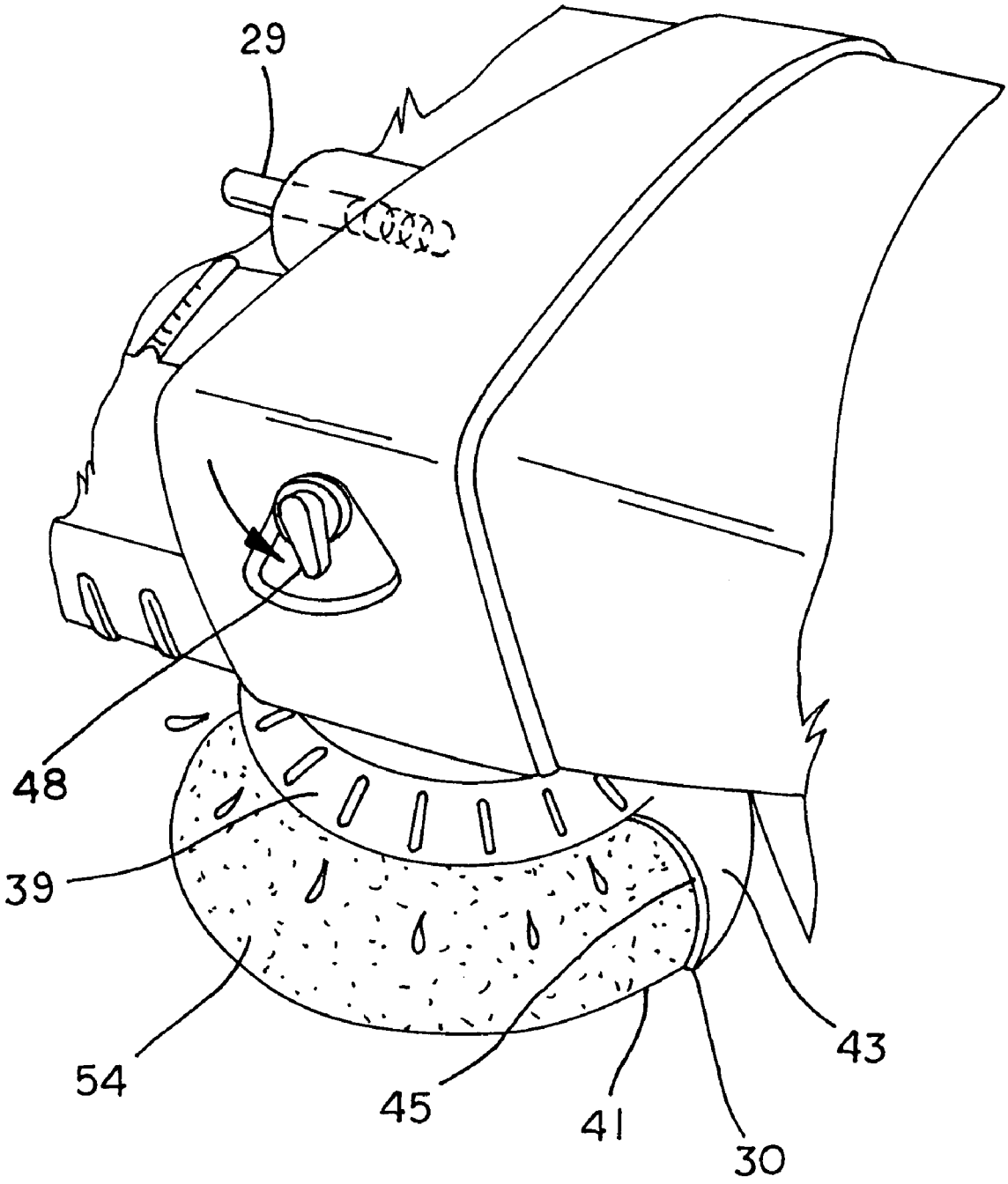
FIG. 6 is an enlarged fragmentary view in perspective illustrating the second detachable water toy disposed in the second receiving area.
Figure 7:
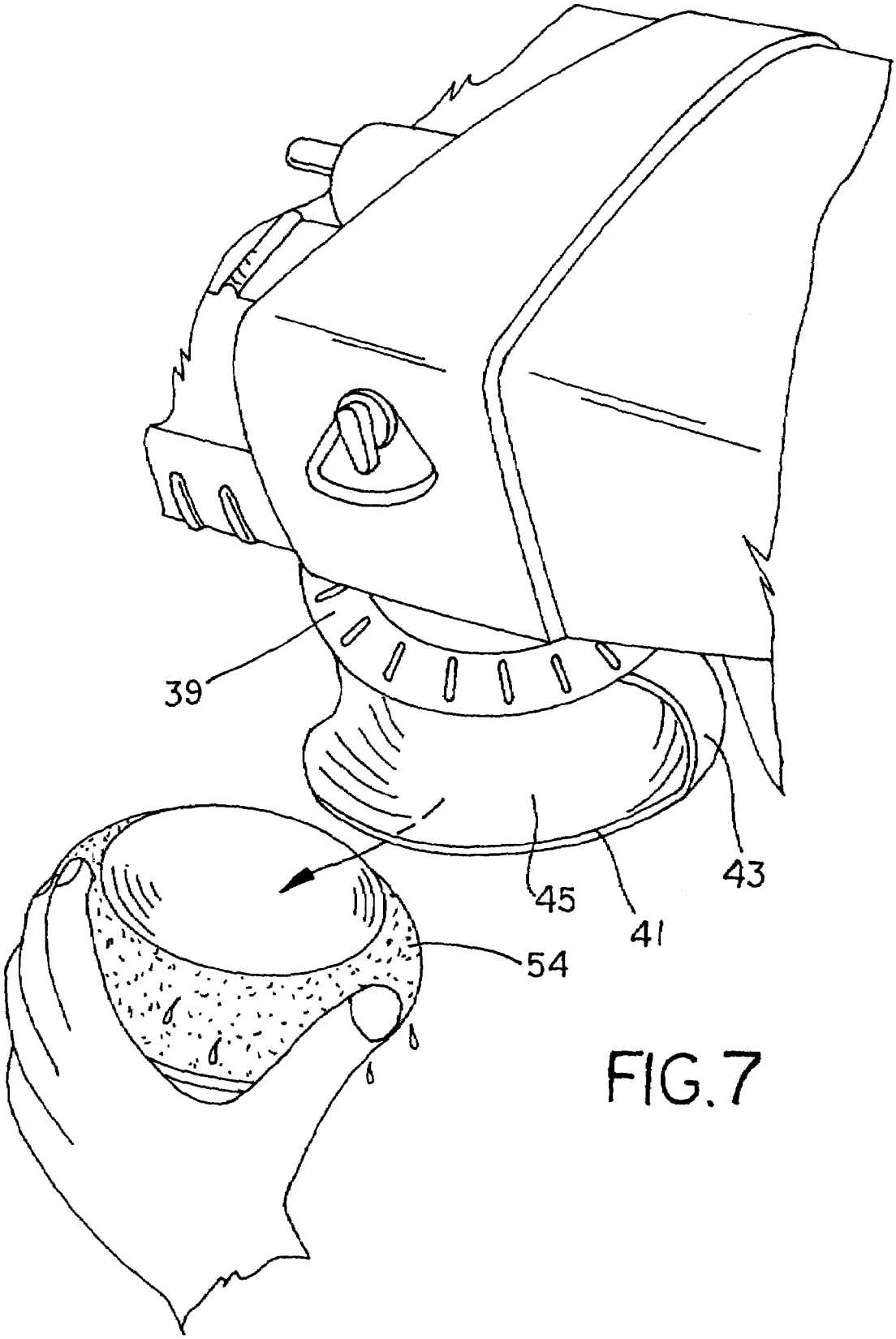
FIG. 7 is an enlarged fragmentary view in perspective similar to FIG. 6 and illustrating the second detachable water toy being removed from the second receiving area.

Referring now to FIGS. 6-7, in accordance with the disclosed example the second receiving area 30 includes a pair of spaced apart panels 39 and 41. The panels 39 and 41 are connected by an arm 43, such that a space 45 is defined between the panels 39 and 41. As can be seen in FIG. 6, when the second water toy 54 is disposed in the second receiving area 30, the second water toy 54 is disposed between the panels 39 and 41. Preferably, the panels 39 and 41 may be curved or otherwise shaped so as to correspond to or generally complement the shape of the second water toy 54.

Figure 8:
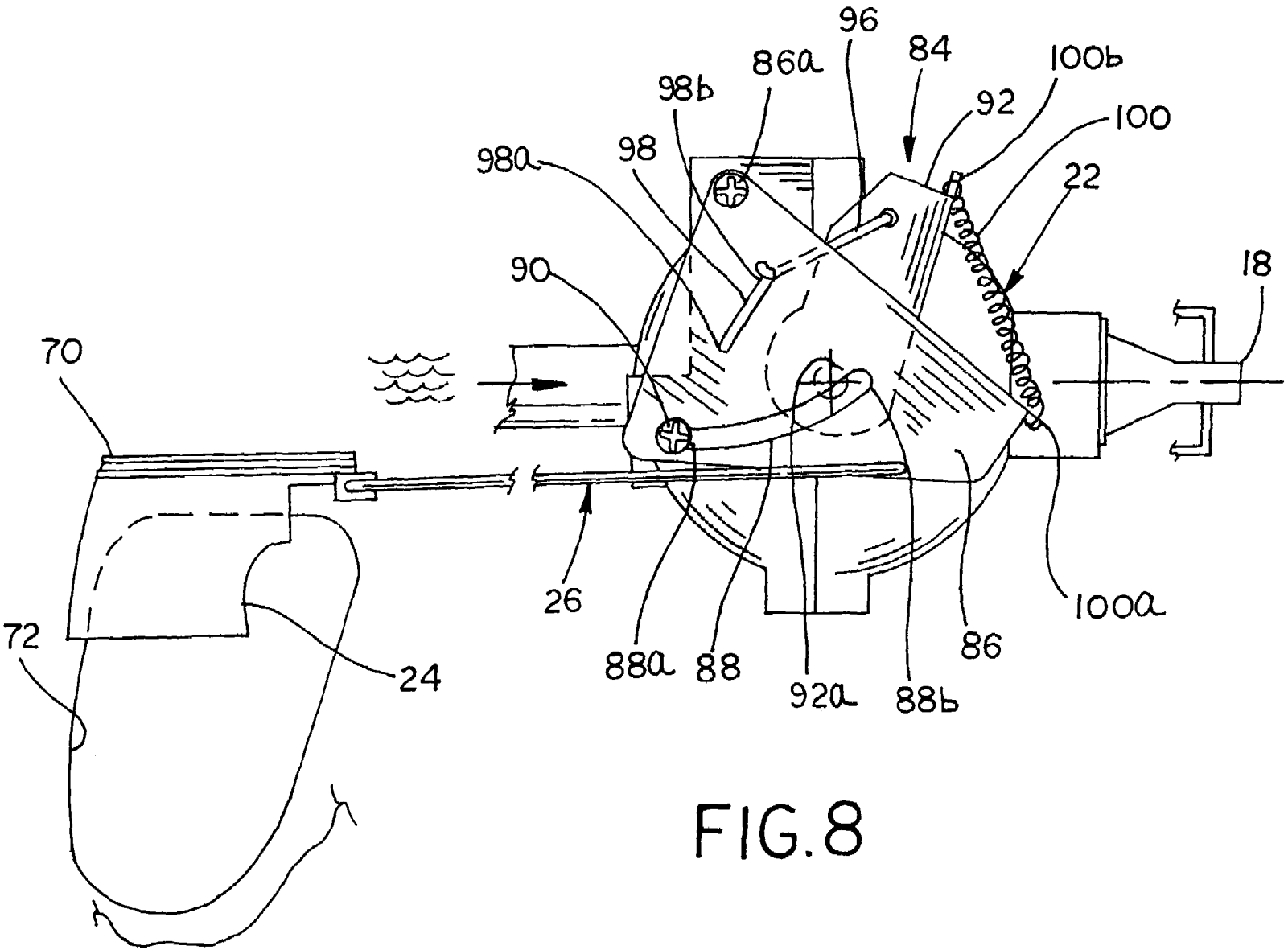
FIG. 8 is an enlarged fragmentary bottom plan view of a trip valve mechanism illustrated in a first position.
Figure 9:
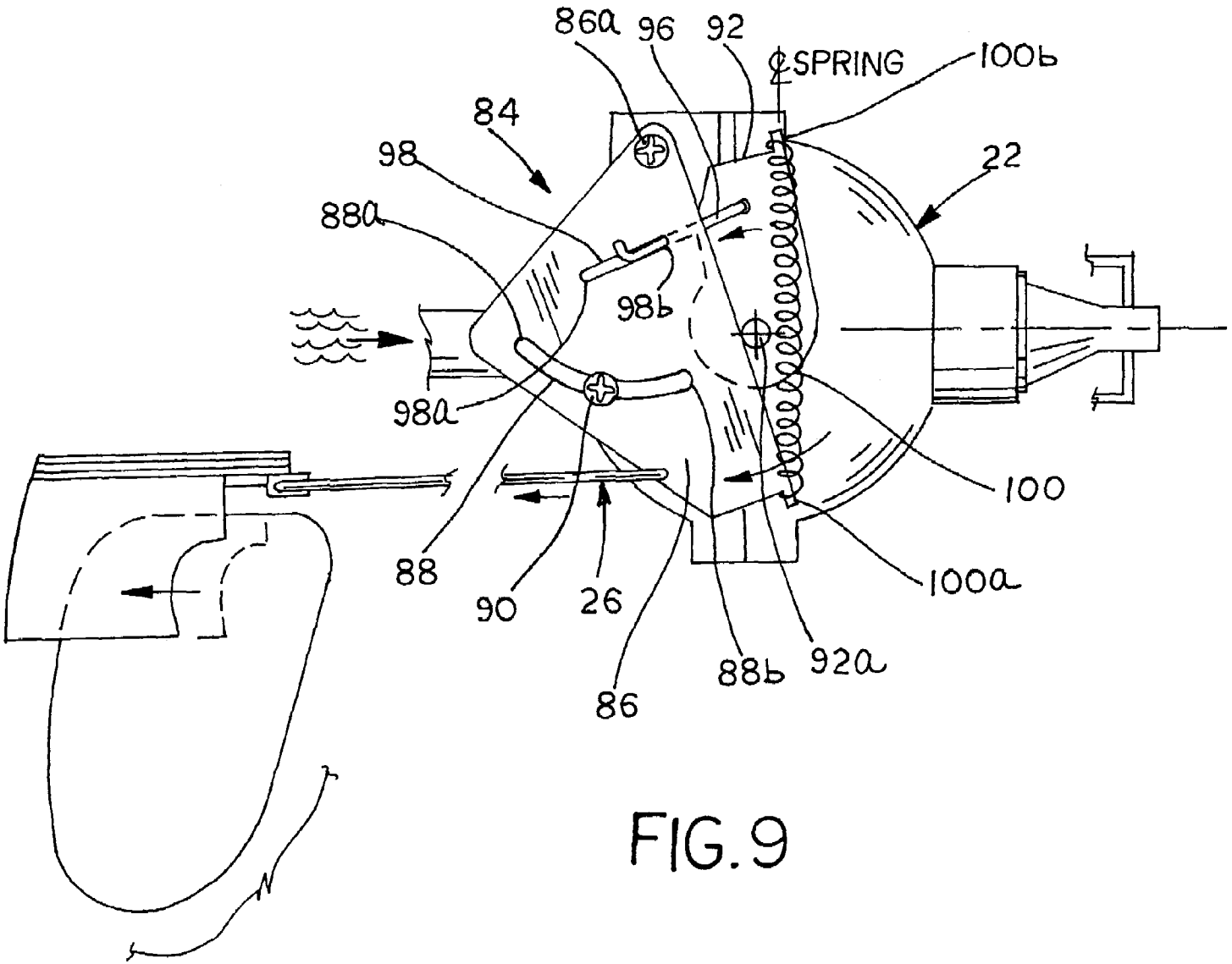
FIG. 9 is an enlarged fragmentary bottom plan view similar to FIG. 8 and illustrating the trip valve mechanism in a second position.
Figure 10:
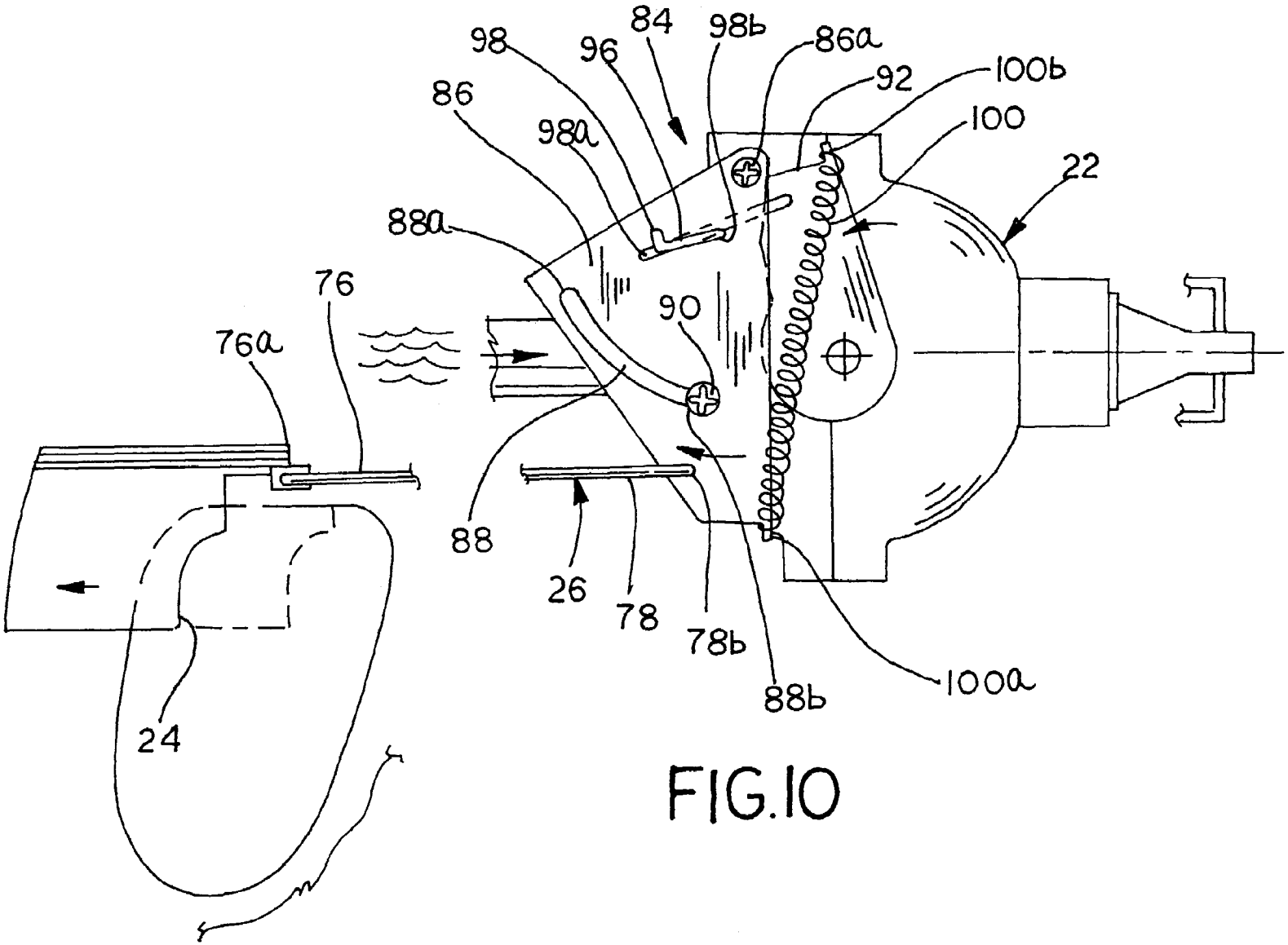
FIG. 10 is an enlarged fragmentary bottom plan view similar to FIGS. 8 and 9 and illustrating the trip valve mechanism in a third position.

Referring now to FIGS. 8, 9, and 10, the valve assembly 22 (the underside of which is shown) may include a trip assembly 84 which is operatively connected to the trigger 24 via the linkage 26. The trip assembly 84 controls the actuation of the valve assembly 22 and enables the user to shoot water as desired. The trip assembly 84 includes a pivot plate 86 which pivots about a pivot point 86*a*. A forward end 78*b* of the rod 78 is attached to the pivot plate 86. The pivot plate 86 includes a slot 88 having a pair of ends 88*a* and 88*b*, and a stop screw 90 is mounted so as to extend through the slot 88. A lever 92 is operatively connected to a conventional rotary valve 94 disposed within the valve assembly 22, and the lever 92 is pivotable about a pivot point 92*a*. The lever 92 is connected to the plate 86 by a link arm 96 which fits within a slot 98 in the pivot plate 86. The slot 98 includes a pair of ends 98*a* and 98*b*. A spring 100 is connected to the pivot plate 86 at 100*a* and to the lever 92 at 10*b*. When the plate 86 and the lever 92 are positioned as shown in FIG. 8, the rotary valve 94 is off, such that no water will be ejected from the outlet nozzle 18.

Referring now to FIG. 9, when the trigger 24 is retracted (to the left when viewing FIG. 9) from an initial position shown in FIG. 8 to an intermediate position of FIG. 9, the rod 78 pulls on the pivot plate 86, causing the pivot plate 86 to shift in a generally clockwise direction about the pivot 86*a*. In the process, the end 88*b* of the link arm 96 pulls the lever 92, causing the lever 92 to rotate in a generally counterclockwise direction about the pivot point 92*a*, thus opening the rotary valve 94 such that water may be ejected from the nozzle 18.

Referring now to FIG. 10, when the trigger 24 is displaced sufficiently to the left to a fully retracted position as shown in FIG. 10, the pivot plate 86 may pivot sufficiently far that the stop screw 90 comes into contact with the end 88*b* of the slot 88. Eventually, the spring with 100 will pass the pivot 92*a*, which causes the spring 100 to apply a further biasing force to the lever 92, thereby causing the lever 92 to rotate more rapidly in the counter-clockwise direction about the pivot point 92*a*. The link arm 96 may come into contact with the end 98*a* of the slot 98, thus limiting the rotational movement of the lever 92. The valve 94 may be arranged such that the valve is turned fully on when the lever 92 is rotated far enough. Releasing the trigger 24 will permit the trip assembly 84 to return to the position of FIG. 8.

Consequently, in accordance with the disclosed example, the trip assembly 84 serves to define three possible positions for the rotary valve 94. These positions include a first position shown in FIG. 8 (in which the rotary valve 94 is closed), a second position shown in FIG. 9 (in which the rotary valve 94 is in a partially open position), and a third position shown in FIG. 10 (in which the rotary valve 94 is in a fully open position). Other configurations may be chosen, including by way of example rather than limitation, a closed position and one or more open positions for the rotary valve 94. As a still further alternative, the toy water gun 12 may simply be provided with a more conventional valve at the outlet nozzle 18 of the type that is commonly employed in toy water guns. Additional description of the valve 22 and/or the trip assembly 84 can be found in U.S. Pat. No. 6,631,830, entitled "Snap Action Ball Valve Assembly and Liquid Dispenser Using the Same", the entire disclosure of which is incorporated herein by reference.

Figure 11:
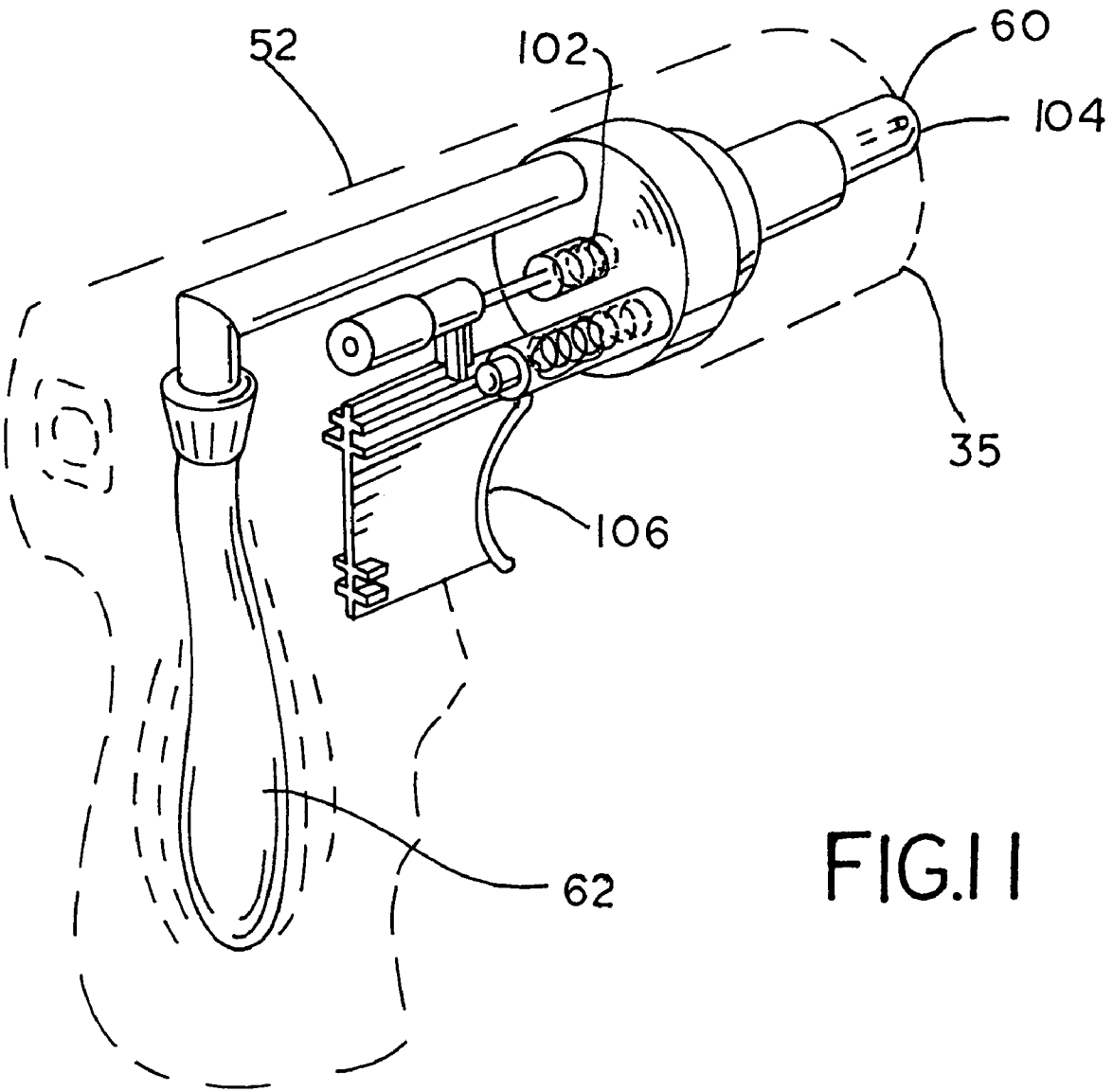
FIG. 11 is an enlarged elevational view, partly in cutaway, of the first detachable water toy.
Figure 12:
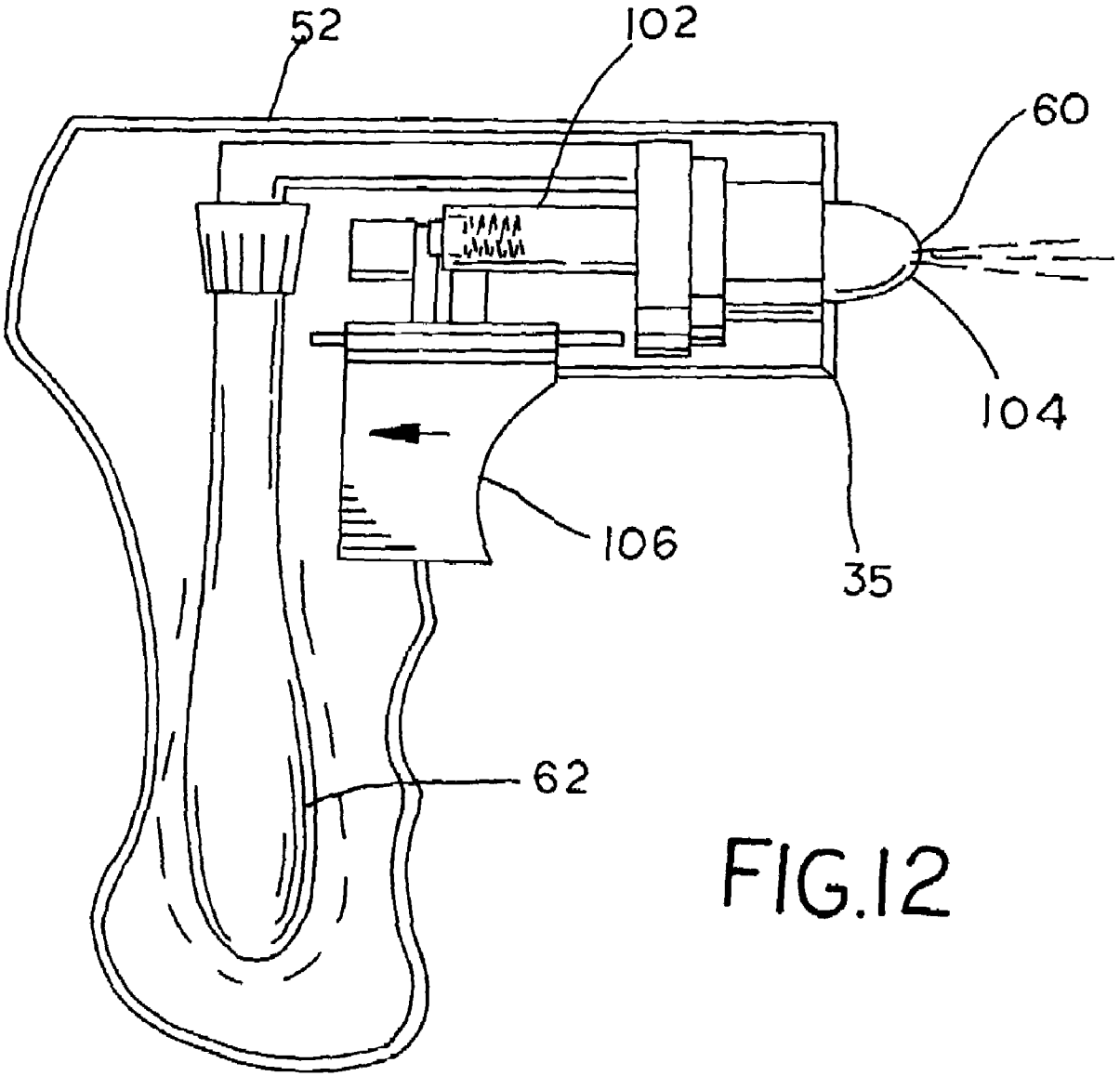
FIG. 12 is an enlarged fragmentary view in perspective of the interior of the first detachable water toy.

Referring now to FIGS. 11 and 12, the first detachable water toy 52 is shown therein in greater detail. In accordance with the disclosed example, the first water toy 52 preferably includes a spring-loaded check valve 102 disposed generally adjacent to the forward end 35 of the water toy 52. It will be understood that a tip 104 of the nozzle 60 may be placed in flow communication with the output port 34 of the first receiving area 28 such that water flowing through the conduit 32 may be routed into the reservoir 62 of the water toy 52 upon operation of the rotary valve 36 as will be explained in greater detail below. It will further be understood that the tip 104 reciprocates to the left and the right when viewing FIG. 12, such that the check valve 102 can be opened or closed. When tip 104 is shifted toward the left when viewing FIG. 12, such as when the water toy 52 is disposed in the receiving area 28, the check valve 102 is open such that water under pressure may flow into the reservoir 60. Alternatively, the check valve 102 may be arranged such that the check valve 102 opens in response to the pressure when the reservoir 16 is pressurized and the valve 36 is opened to route pressurized water through the port 34 and into the nozzle 60 and hence into the reservoir 62. A trigger 106 is provided and is operatively connected to the check valve 102, such that the water toy 52 may be operated by opening and closing the check valve 102 using the trigger 106.

Figure 13:
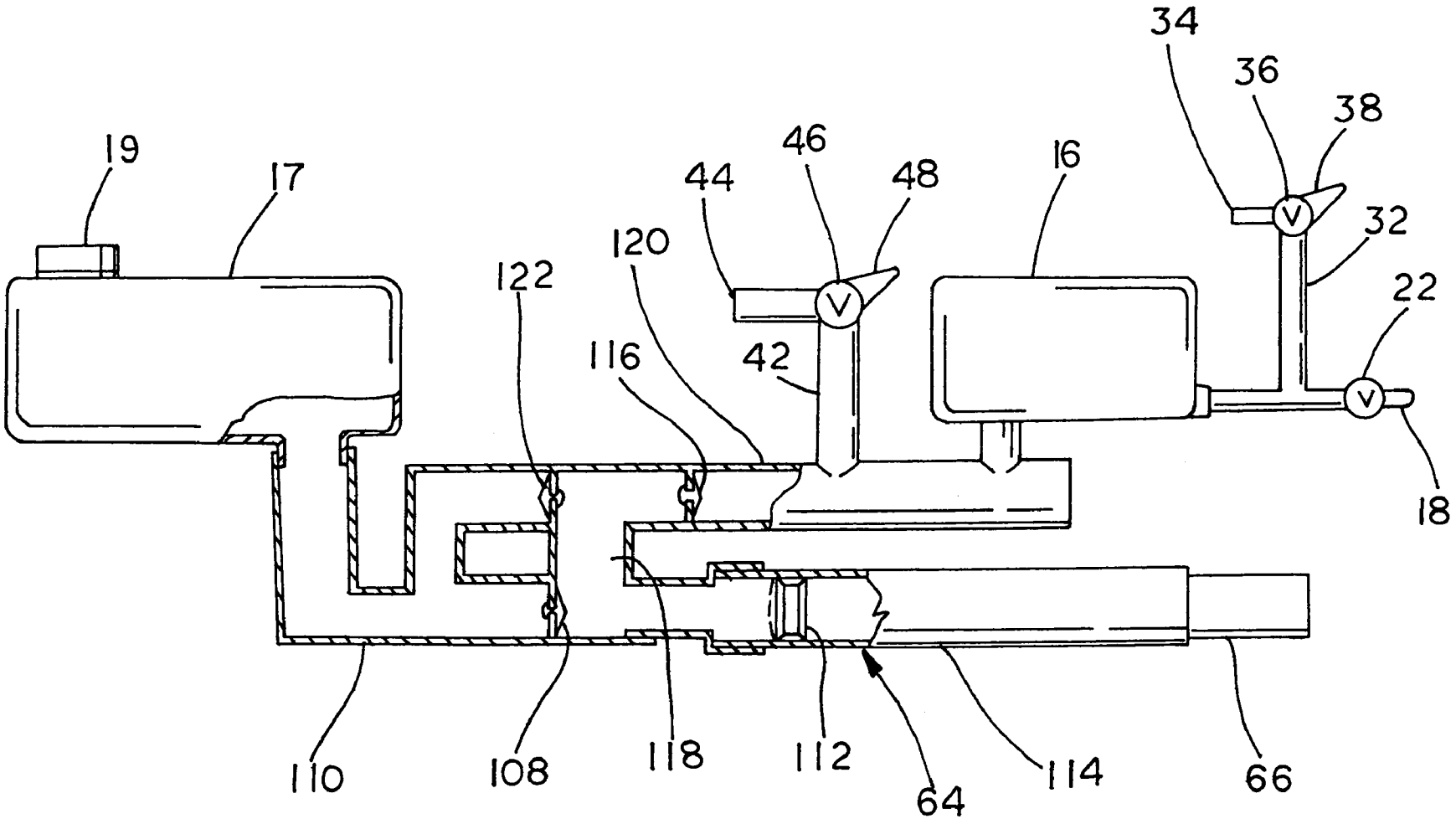
FIG. 13 is an enlarged fragmentary cross-sectional view illustrating various elements of the reservoir pressurizing mechanism.

Referring now to FIG. 13, the fluid flow path of the primary water gun 12 will be described in greater detail. The fill cap 19 of the second reservoir 17 may be removed such that water or any other suitable fluid may be placed in the second reservoir 17. The second reservoir 17 is connected to a one-way valve 108 by a conduit 110. The pressurizing mechanism 64 includes a plunger 112, which reciprocates within a tubular conduit 114 upon reciprocal operation of the handle 66. Another one-way valve 116 is provided, and is connected to the first one-way valve 108 by a conduit 118. The one-way valve 116 is also connected to the reservoir 16 by a conduit 120. An overpressure valve 122 is preferably provided, with the overpressure valve 122 in flow communication with both the conduits 110 and 118. The overpressure valve limits the maximum pressure within the reservoir 16.

To operate the pressurizing mechanism 64, a user (not shown), grips the handle 66 and slides the handle 66 generally to the right when viewing FIG. 13 to create a vacuum in the conduit 114. The vacuum acting on the one-way valve 108 opens the valve 108 and allows fluid to flow from the reservoir 17 into the conduit 114. When the handle 66 is pushed to the left, the valve 108 closes and the water contained within the conduit 114 is forced through the conduit 118, through the one-way valve 116, and into the reservoir 16 via the conduit 120. Consequently, the internal conduits, including the conduit 120 leading to the reservoir 16 as well as the conduits 32 and 42 leading to the first and second receiving areas 28, 30, respectively, all get filled with water. Additional water may be pumped into the reservoir 16 upon repeated actuation of the handle 66, such that any air within the reservoir 16 applies pressure to all of the water contained in the pressurized part of the system. The over-pressure valve 122 prevents too much pressure buildup in the pressurizing mechanism 64 by routing water back into the conduit 110 and hence back into the reservoir 17.

When a user desires to operate the toy water gun system 10, the user may choose between the three water toys shown. Using the pressurizing mechanism 64 as described above, the appropriate pressure head is applied by reciprocating the handle 66 and forcing water into the system until the reservoir 16 is suitably pressurized. In the event the user wishes to eject water from the outlet nozzle 18 of the primary water gun 12, the user simply actuates the trigger 24 as described above.

The user may also desire to detach and use a selected one of the detachable water toys 52 and/or 54. In a preferred mode of operation, the user will first suitably pressurize the reservoir 16 using the pressurizing mechanism 64 as described above. In the event the user desires to operate the second water toy 54, the user manipulates the spring-loaded valve 46 disposed generally adjacent to the second receiving area 30, which allows pressurized water contained within the conduit 42 to flow out of the output port 44 and into the second water toy 54, thus soaking the second water toy 54. As can be seen in FIG. 7, the user then releases the handle 48 of the valve 46, such that the rotary spring 50 returns the valve 46 to a closed position. The user then removes the soaked second detachable water toy 54 from the second receiving area 30, and may then throw the second detachable water toy 54 or otherwise use the toy in any desired manner.

When the user desires to use the first water toy 52, the first detachable water toy 52 should be placed in the first receiving area 28, with the plunger 29 engaging the recess 31 on the rearward end 33 of the first detachable water toy 52, and with the forward end 35 disposed in the recess 37. Accordingly, the plunger 29 serves to bias the second detachable water toy 52 forwardly, such that the forward end 35 is pressed into the recess 37 so that the toy 54 may be suitably retained in the first receiving area 28. It will be noted that the nozzle 60 of the first detachable water toy 52 will be in flow communication with the output port 34 of the conduit 32. Further, when the forward end 35 of the first detachable water toy 52 is in contact with the recess 37 under the biasing force of the plunger 29, the check valve will permit flow communication between the output port 34, the nozzle 60, and the reservoir 62. When the user desires to fill the reservoir 62, assuming the reservoir 16 has been suitably pressurized using the pressurizing mechanism 64 as described above, the user simply manipulates the handle 38 so as to open the valve 36, which routes pressurized water through the output port 34 of the first receiving area 28, through the nozzle 60 of the first detachable water toy 52, and into the reservoir 62 contained within the first detachable water toy 52. When a quantity of pressurized water is contained within the reservoir 62, the user closes the rotary valve 36 by simply releasing the handle 38. The first detachable water toy 52 is then ready to be removed from the first receiving area 28 in order to be used.

When the user desires to use the first detachable water toy 52, the user may rotate the first detachable water toy 52 from the position shown in FIGS. 3 and 4 toward the position illustrated in FIG. 5, such that the user can grasp a handle portion of the first detachable water toy 52. The first detachable water toy 52 may then be pushed forwardly by the user so as to disengage the plunger 29 from the recess 31, thus permitting the water toy 52 to be removed from the first receiving area 28 by pulling the rearward end of the water toy 52 away from the housing 14. The water toy 52 may then be operated using the trigger 106 which opens the check valve 102, such that pressurized water contained within the reservoir 62 may be suitably ejected from the nozzle 60.

It will be understood that the toy water gun system 10 may include additional or fewer detachable water toys as desired. The number and location of the internal conduits may be readily adaptable to route pressurized water to the desired number of detachable water toys. It will also be understood that the water toy 52 may be suitably adapted to be fired while still attached to the primary water gun 12 at the first receiving station 28. For example, the water toy 52 may include one port for filling the reservoir inside the water toy 52, and a separate port or outlet nozzle to be used when firing the water toy 52 in a conventional manner.

The teachings of the present invention may also be applied to an air-operated toy gun system, in which a primary toy gun and/or one or more of the detachable toys are air-operated and are arranged to shoot, by way of example rather than limitation, soft foam projectiles using a blast of compressed air. In the event the toy gun system is arranged for air operation, each of the toy guns (i.e., the primary toy gun, the first detachable toy gun and the second detachable toy gun) each may be provided with a suitable launching station of type that receives and holds a soft foam projectile in preparation for launch. Further, one or more of the toy guns may include an air tank that may be pressurized to hold compressed air for launching the projectiles. One example of a toy gun having an air tank that may be pressurized to launch foam projectiles is illustrated and described in U.S. Pat. No. 5,515,837, entitled "Safety Nozzle for Multi-Shot Projectile Shooting Air Gun" which issued on May 14, 1996, and which is hereby expressly incorporated by reference herein in its entirety.

When such a toy gun system is provided, it will be understood that the above-described internal conduits will route pressurized air to the appropriate output ports at their corresponding receiving areas, such that an air-operated detachable toy gun disposed in an appropriate one of the receiving areas may be pressurized via the output port at that receiving area using a corresponding one of the valves. Additionally, an air-operated toy gun disposed in one of the receiving areas may be arranged to be fired while still disposed in one of the receiving areas. In such an exemplary form, the air operated toy gun may be pressurized through and inlet port on the toy gun, and may include a second outlet port disposed adjacent a launching station of the foam projectile. A one way valve responsive to air pressure may be provided such that the detachable air-operated toy gun may be automatically pressurized when the primary toy gun is pressurized. The projectile of the detachable toy gun may be launched using a trigger attached to the detachable toy gun, or by actuating the trigger on the primary toy gun.

Figure 14:
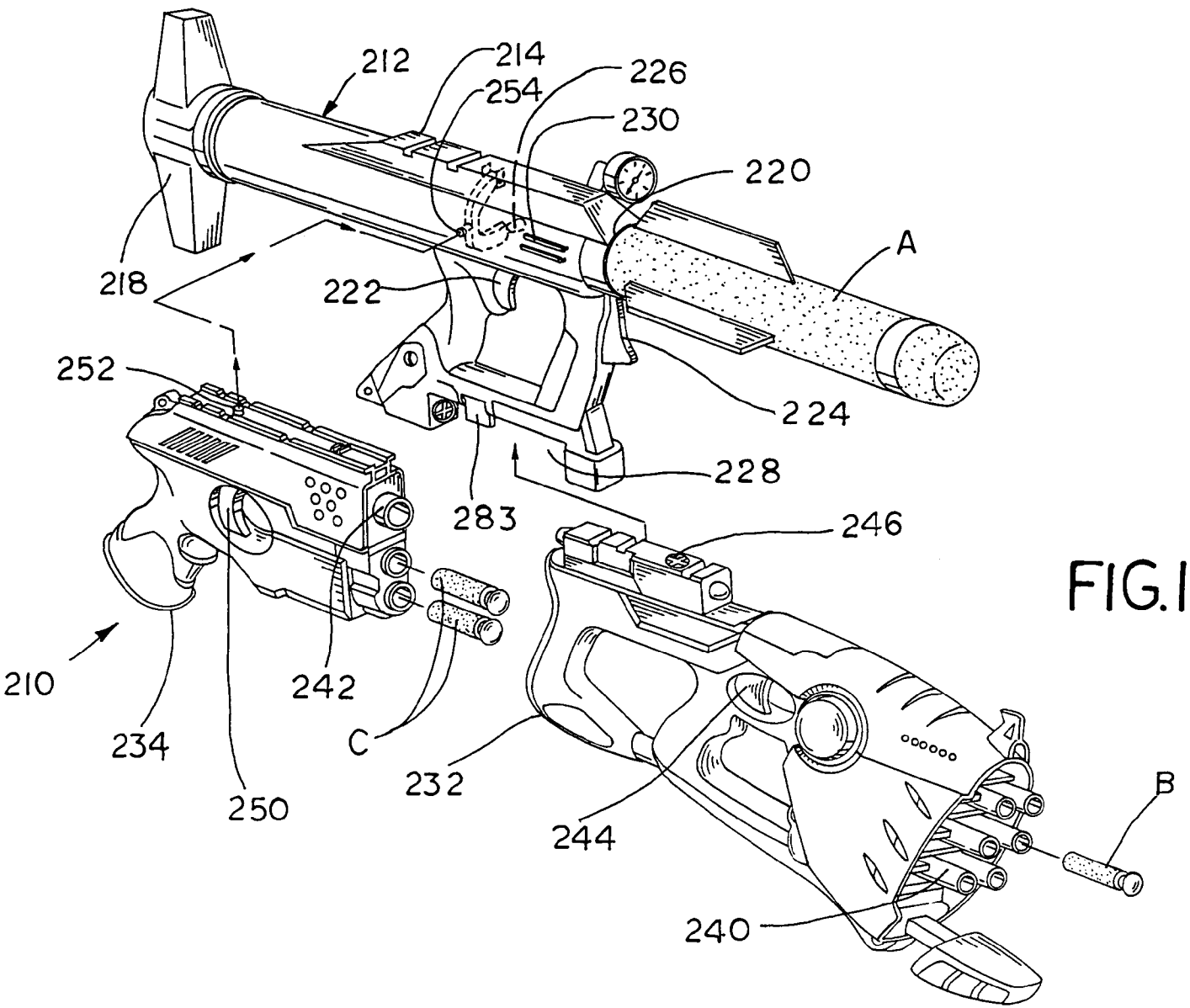
FIG. 14 is a perspective view of a toy gun system assembled in accordance with the teachings of another disclosed example of the present invention.
Figure 16:
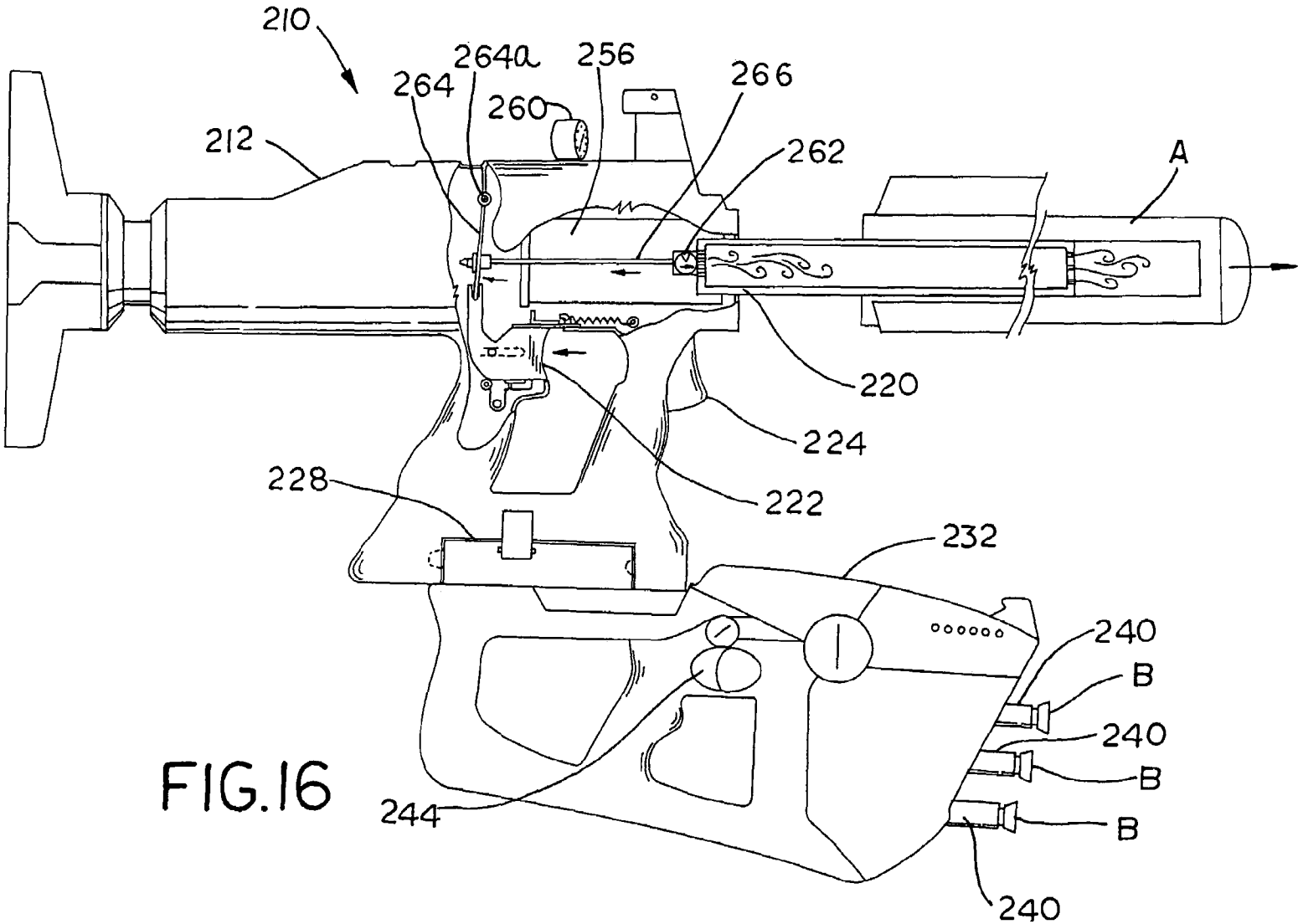
FIG. 16 is a fragmentary view, partly in section, similar to FIG. 15 and illustrating the primary gun being fired.

Referring now to FIG. 14, a toy gun the system assembled in accordance with the teachings of another disclosed example of the present invention is shown and is generally referred to by the reference 210. The toy gun system 210 includes a primary gun 212 having a housing 214 and a pneumatic system 216 disposed within or otherwise attached or mounted to the housing 214 (the pneumatic system 216 is best visible in FIGS. 15 and 16). The pneumatic system 216 is preferably pressurizable, such as by using a reciprocating pump 218 of the type commonly employed in the art. The primary gun 212 also includes a launch station 220 operatively connected to the pneumatic system 216, such that a foam projectile A, or other suitable projectile, may be launched from the launch station 220 as will be explained in greater detail below.

The primary gun 212 also includes a first trigger 222, a second trigger 224, and a third trigger 226. The housing 214 of the primary gun 212 preferably includes a first receiving area 228 and a second receiving area 230. A first detachable gun 232 is arranged to be mounted to the primary gun 212 at the first receiving area 228 in a manner that will be explained in greater detail below. A second detachable gun 234 is arranged to be mounted to the primary gun 212 at the second receiving area 230, also in a manner that will be explained in greater detail below.

Figure 22:
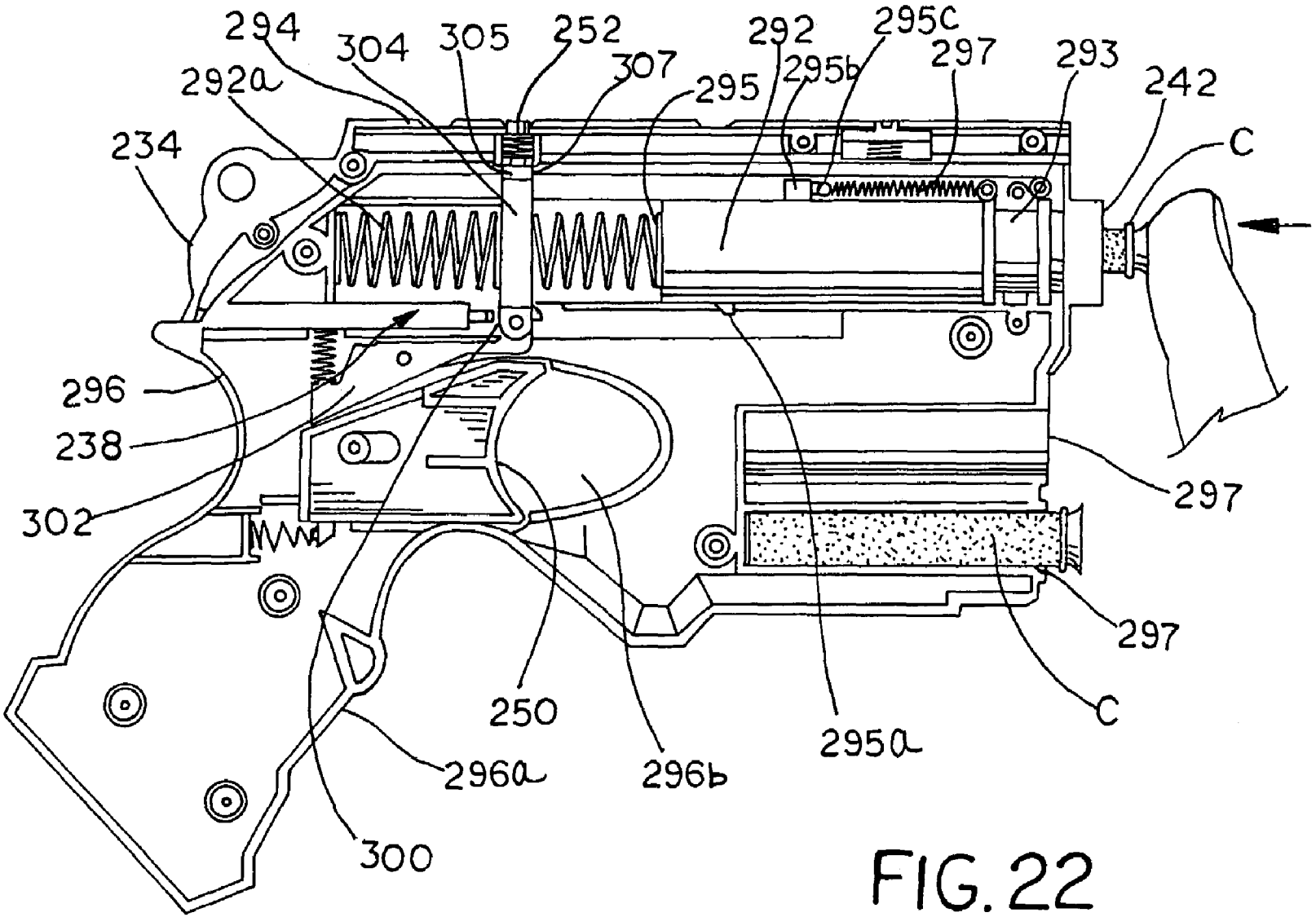
FIG. 22 is an enlarged fragmentary top plan view, partly in section, and illustrating the second detachable gun attached to the second receiving area of the primary gun.
Figure 23:
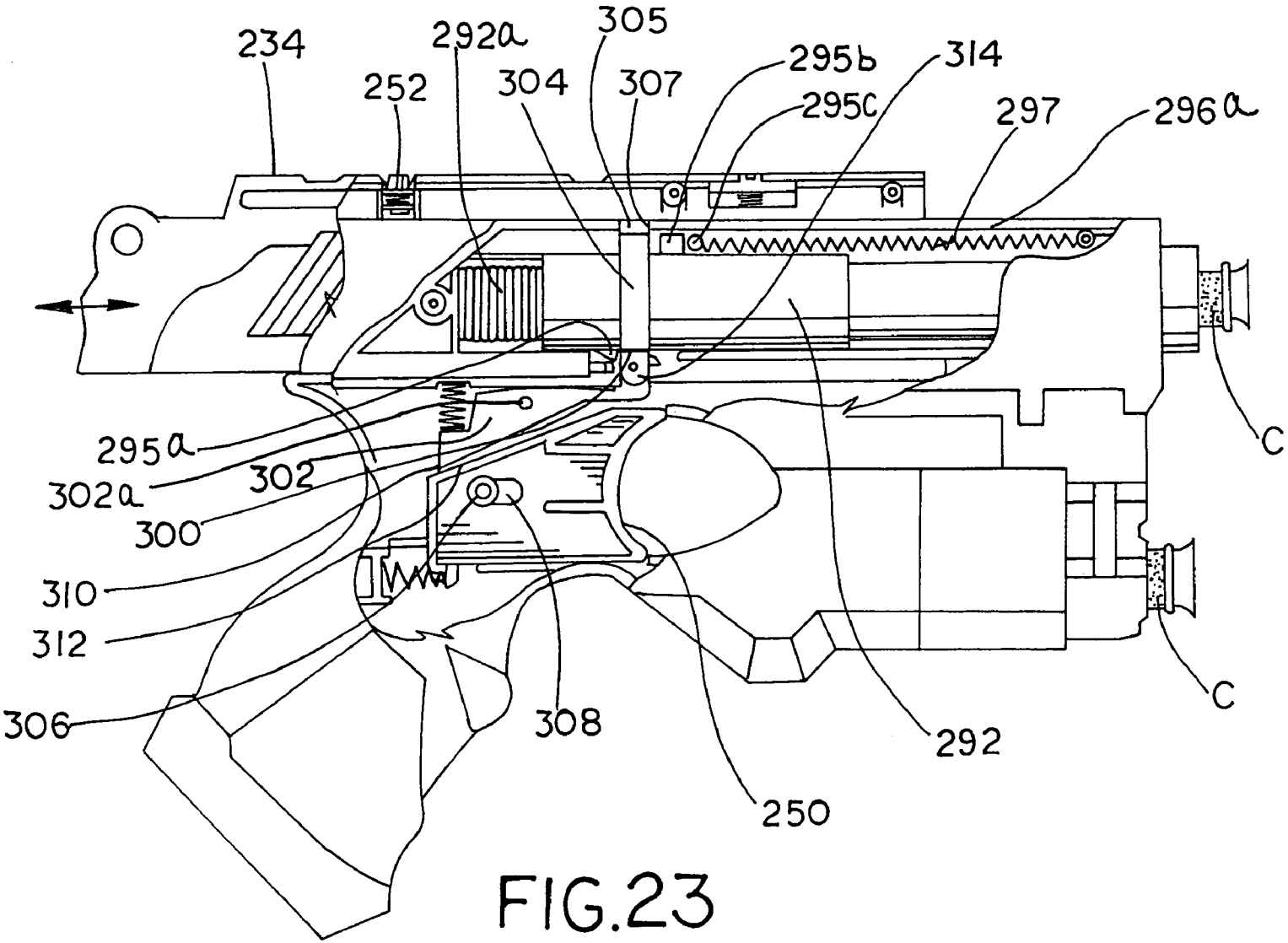
FIG. 23 is another in large fragmentary top plan view, partly in section, and illustrating the second detachable gun being cocked while attached to the second receiving area of the primary gun.
Figure 24:
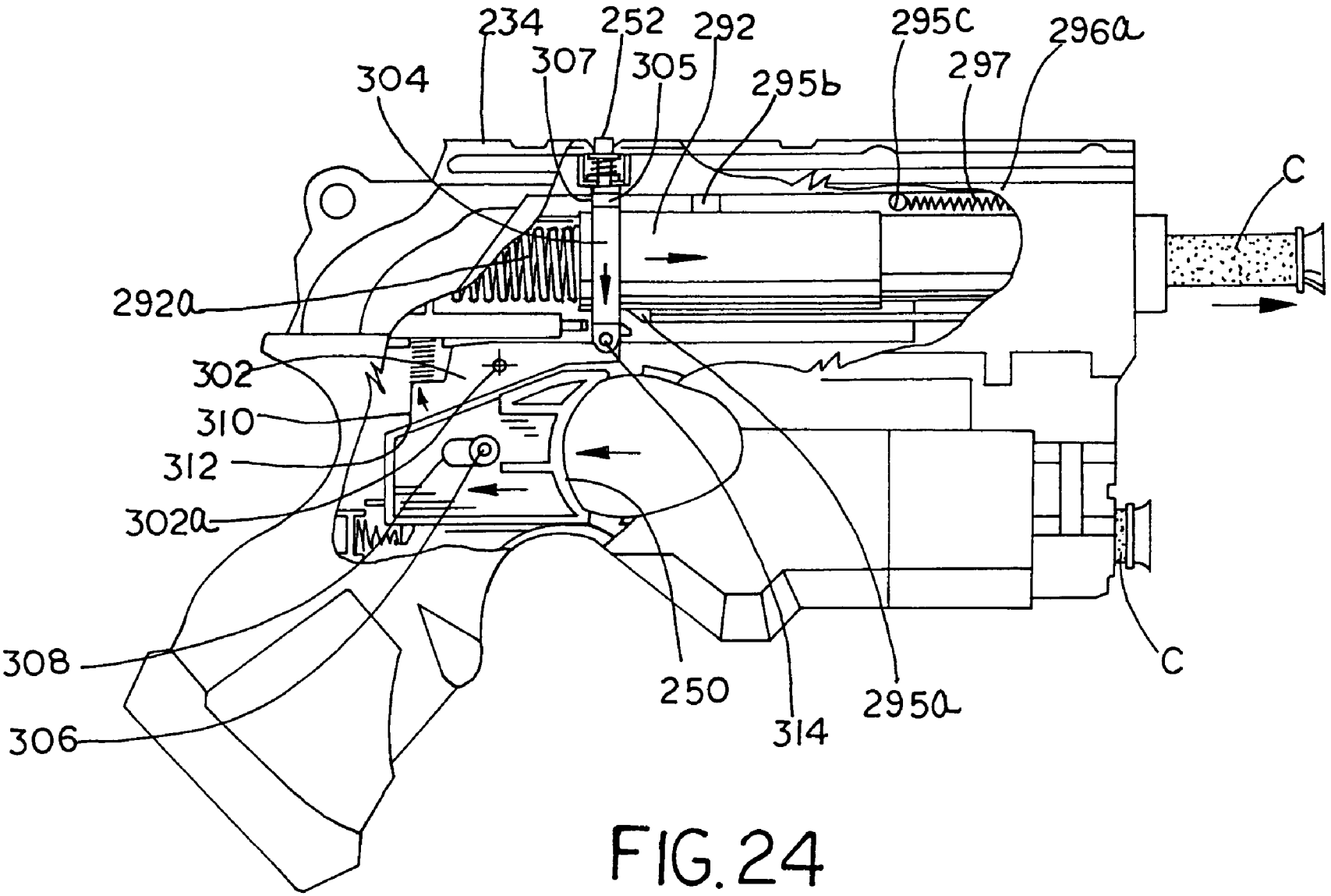
FIG. 24 is another enlarged fragmentary top plan view, partly in section, and illustrating the second detachable gun being fired using the main trigger of the second detachable gun.
Figure 25:
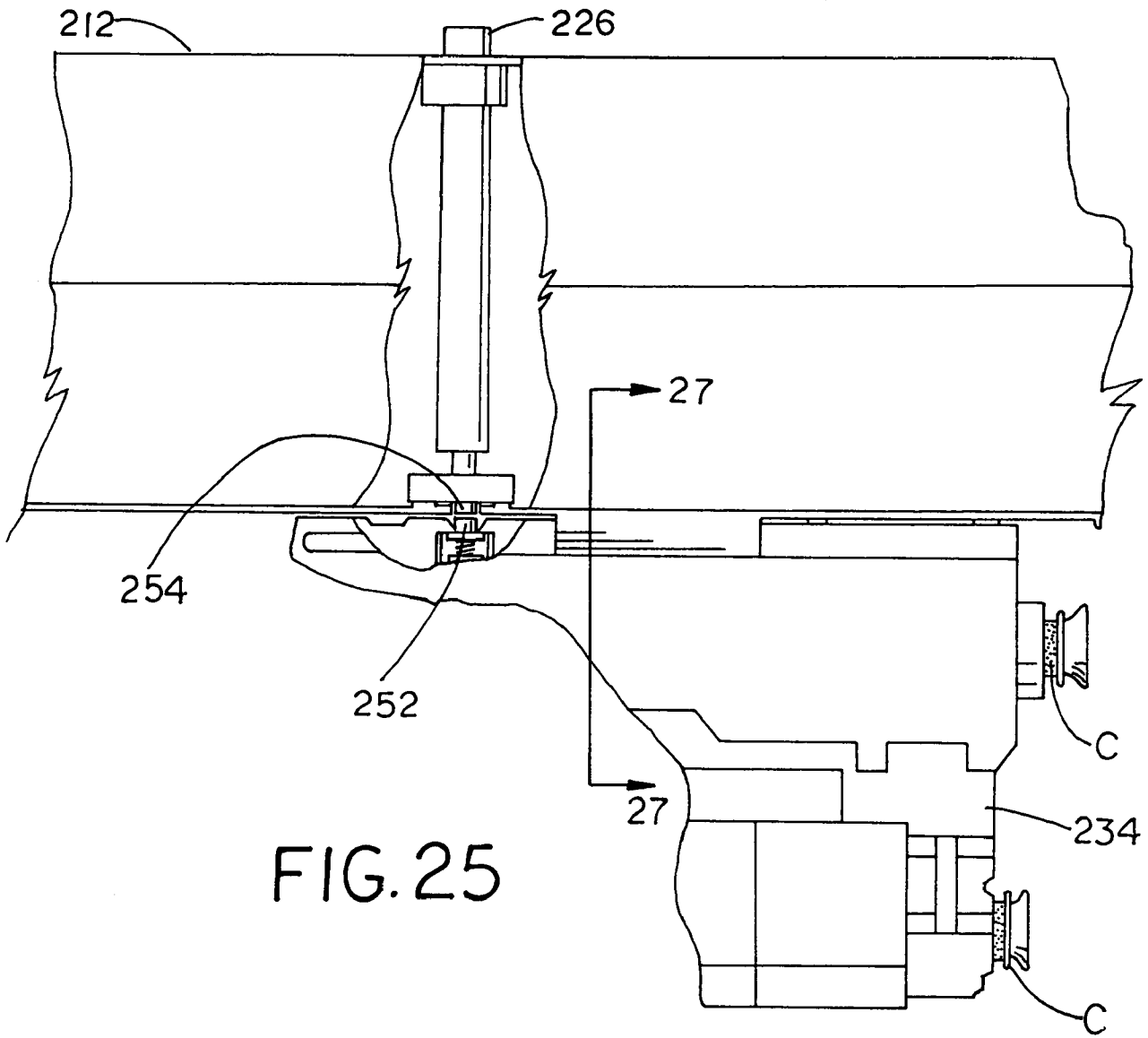
FIG. 25 is an enlarged fragmentary top plan view, partly in cutaway, of the system for actuating the second detachable gun.
Figure 26:
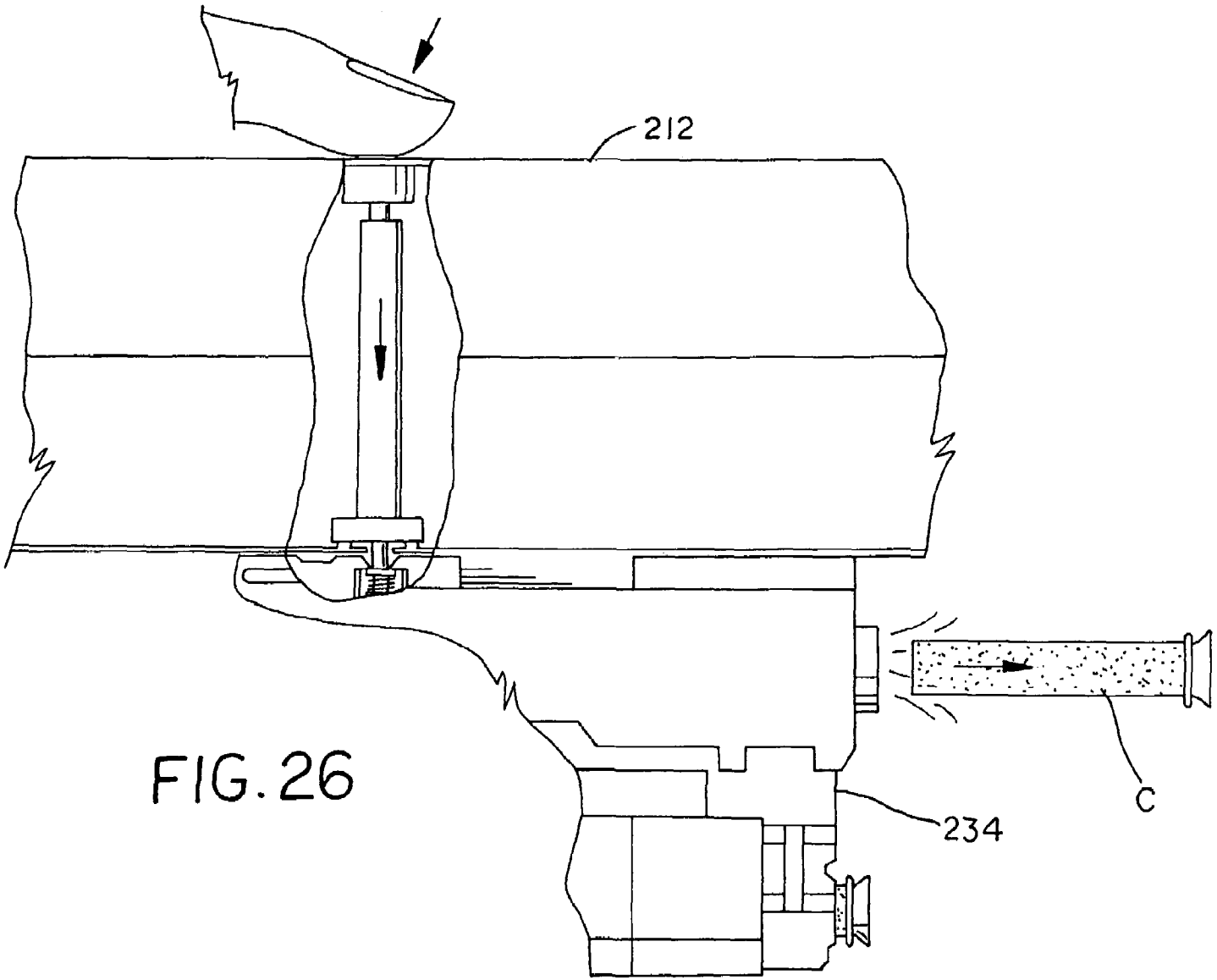
FIG. 26 is an enlarged fragmentary top plan view similar to FIG. 25 and illustrating the second detachable gun being actuated.

The first detachable gun 232 includes a launching system, such as a pneumatic launching system 236 (shown in greater detail in FIG. 28), while the second detachable gun 234 includes a launching system, such as a spring biased launching system 238 (shown in greater detail in each of FIGS. 22-24). The first detachable gun 232 may include a plurality of launch stations 240 for launching one or more projectiles B or other suitable projectiles. Alternatively the first detachable gun 232 may include only a single launch station 240. The second detachable gun 234 includes a launch station 242 for launching a projectile C or other suitable projectile. In the example shown, the first detachable gun 232 includes six (6) launch stations 240. Similarly, in the example shown, the second detachable gun 234 includes only a single launch station 242. Alternatively, additional or fewer launch stations 242 may be provided.

Figure 17:
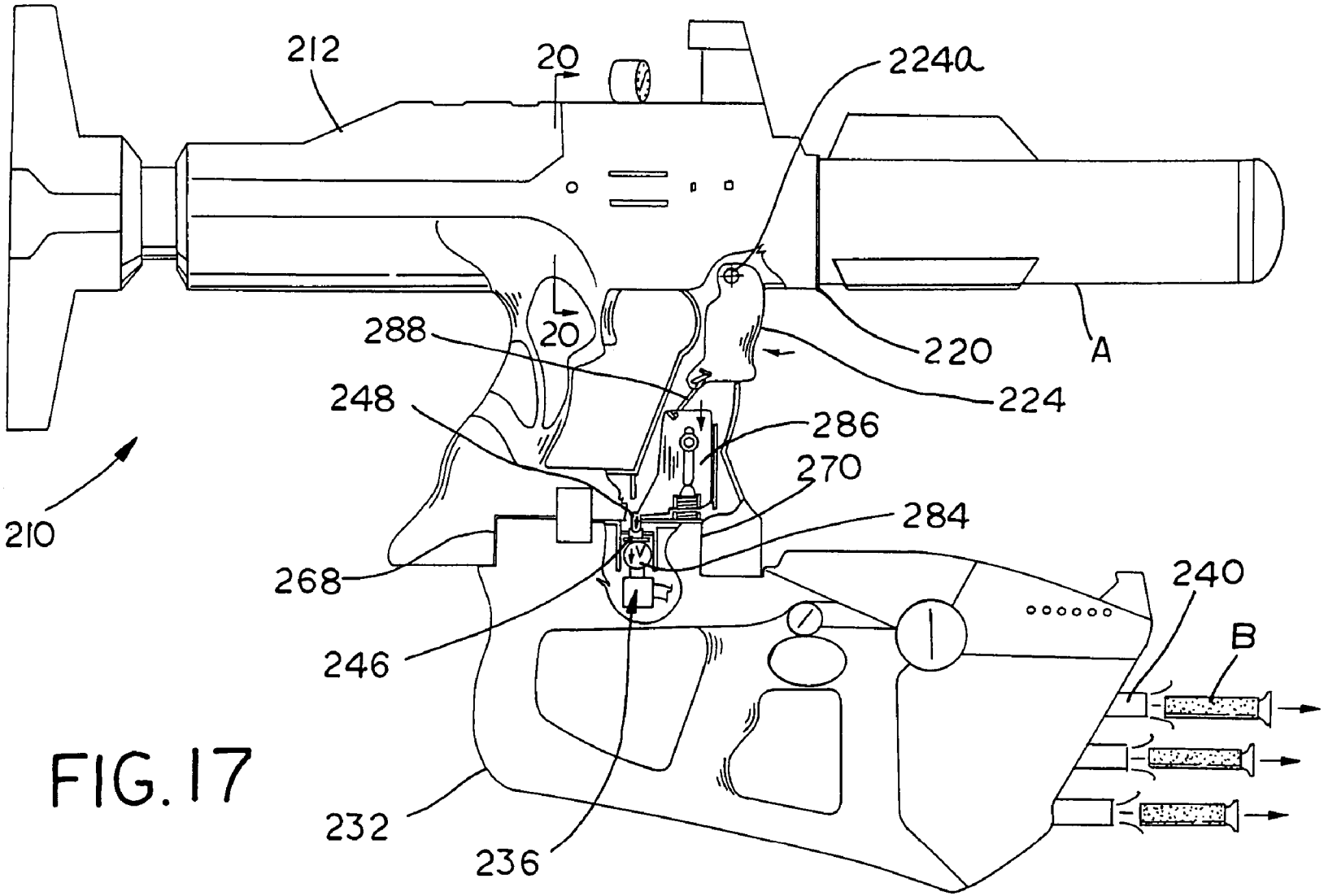
FIG. 17 is another fragmentary view, partly inception, and illustrating the first detachable toy gun being fired using a trigger on the primary gun.

The first detachable gun 232 includes a main trigger 244 and an actuator 246. The primary gun 212 includes an actuator 248 which is operatively connected to the second trigger 224 as shown in FIGS. 15 and 17. As is also shown in FIGS. 15 and 17, the actuator 246 of the first detachable gun 232 is positioned adjacent to the actuator 248 of the primary gun 212 when the first detachable gun 232 is mounted to the primary gun 212 at the first receiving area 228. Accordingly, as will be explained in greater detail below, the first detachable gun 232 may be actuated using ether the main trigger 244, or by using the second trigger 224 of the primary gun 212 when the first detachable gun 232 is attached to the primary gun 212 at the first receiving area 228.

The second detachable gun 234 includes a main trigger 250 and an actuator 252. The primary gun 212 includes another actuator 254 which is operatively connected to the third trigger 226 as shown in FIGS. 20-21 and 25-26. As is also shown in FIGS. 20-21 and 25-26, the actuator 252 of the second detachable gun 234 is positionable adjacent to the actuator 254 of the primary gun 212 when the second detachable gun 234 is mounted to the primary gun 212 at the second receiving area 230. Accordingly, as will be explained in greater detail below, the second detachable gun 234 may be actuated using either the main trigger 250, or by using the third trigger 226 of the primary gun 212 when the second detachable gun 234 is attached to the primary gun 212 at the second receiving area 230.

Accordingly, it will be appreciated that the first detachable gun 232 may be fired using the second trigger 224 when the first detachable gun 232 is attached to the primary gun 212 at the first receiving area 228. The first detachable gun 232 also may be fired using the main trigger 244 when the first detachable gun 232 is either attached to the primary gun 212 at the first receiving area 228, or when the first detachable gun 232 has been detached from the primary gun 212.

Similarly, it will be appreciated that the second detachable gun 234 may be fired using the third trigger 226 when the second detachable gun 234 is attached to the primary gun 212 at the second receiving area 230. The second detachable gun 234 also may be fired using the main trigger 250 when the second detachable gun 234 is either attached to the primary gun 212 at the second receiving area 230, or when the second detachable gun 234 has been detached from the primary gun 212.

Referring now to FIG. 15, the pneumatic system 216 of the primary gun 212 includes the pump 218 and a reservoir 256. The reservoir 256 is in flow communication with the launch station 220. Preferably, a one-way valve 258 is provided between the pump 218 and the reservoir 256, such that the reservoir 256 may be pressurized using repeated strokes of the pump 218. A pressure gauge 260 may be provided in flow communication with the reservoir 256, and the reservoir 256 includes an outlet valve 262 generally adjacent the launch station 220. The first trigger 222 is connected to the outlet valve 262 by a pair of link rods 264 and 266, such that when the first trigger 222 is actuated (by moving the trigger toward the left when viewing FIG. 15 or 16), the link rod 264 pivots about a pivot point 264*a*, such that the link rod 264 pulls the link rod 266 toward the left, thus opening the valve 262 and enabling the pressurized air in the reservoir 256 to escape through the launch station 220, thus launching the projectile A.

Figure 18:
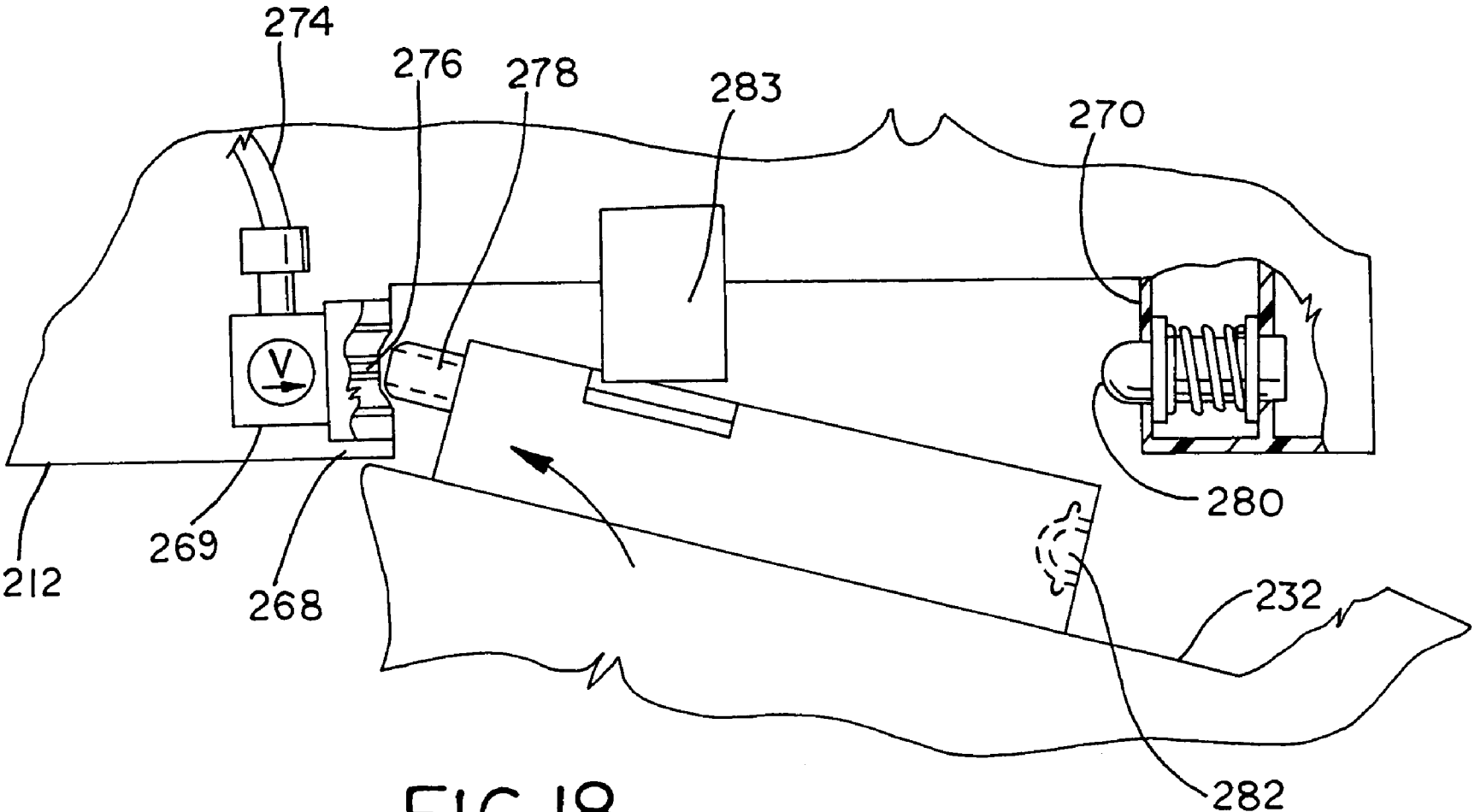
FIG. 18 is an enlarged fragmentary elevational view, partly in section, illustrating the first detachable done being placed in a receiving area defined on the primary gun.
Figure 19:
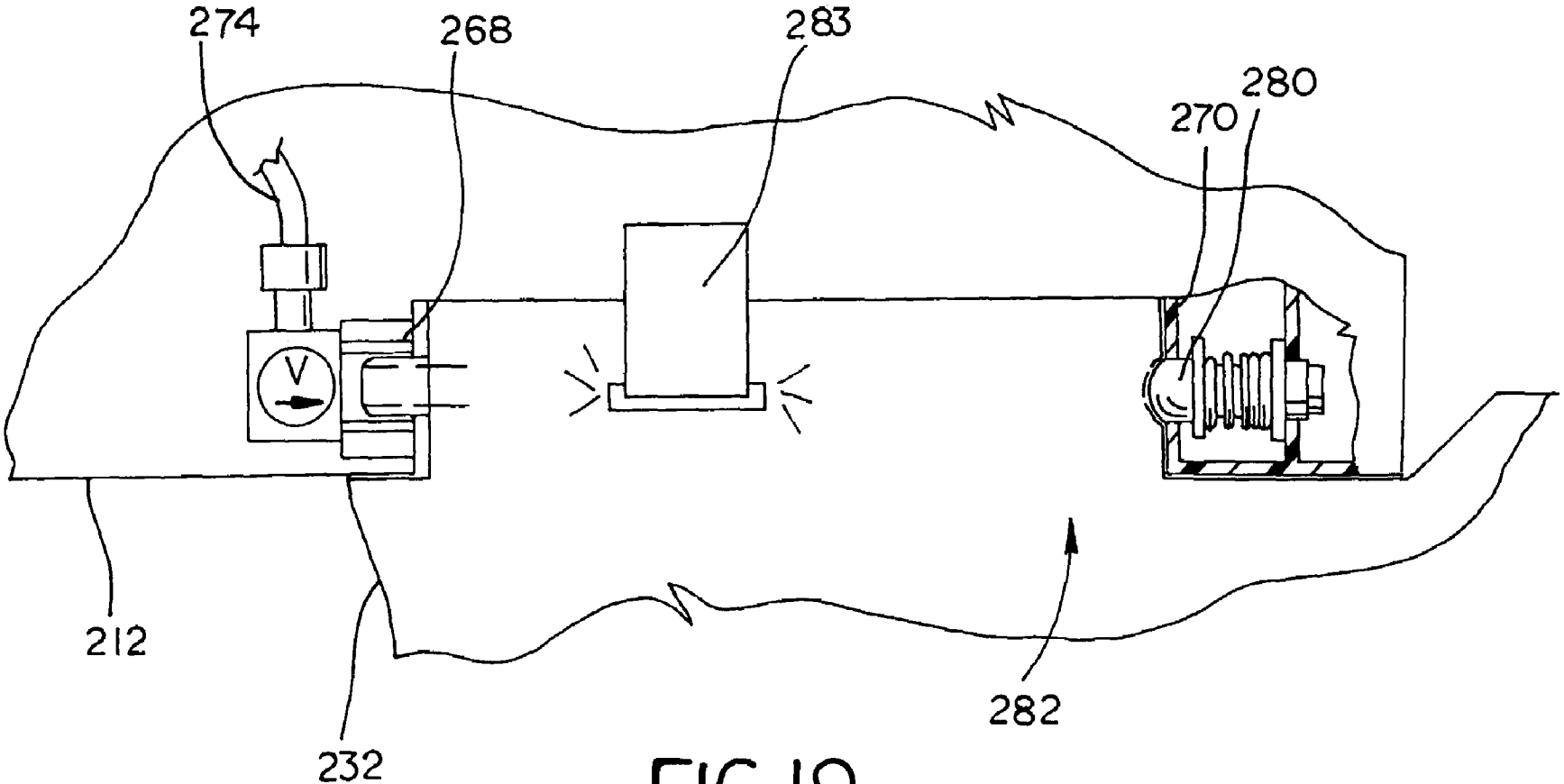
FIG. 19 is another enlarged fragmentary elevational view, partly in section, and illustrating the first detachable gun disposed in the first receiving area of the primary gun.

Referring now to FIGS. 18 and 19, the first receiving area 228 of the primary gun 212 includes a pair of spaced apart abutments 268 and 270. The abutment 268 includes a valve 272 in flow communication with the pneumatic system 216 of the primary gun 212 via a conduit 274. In the example shown, the conduit 274 is connected to the pneumatic system 216 just downstream of the one-way valve 258. The abutment 268 includes a spring-loaded valve 269, which is in flow communication with the conduit 274. The valve 269 includes a port 276 which may be aligned with a corresponding port 278 on the first detachable gun 232 when the first detachable gun 232 is disposed in the first receiving area 228. It will be appreciated that, when the first detachable gun 232 is disposed in the first receiving area 228 in the manner to be explained in greater detail below, the pneumatic system 236 of the first detachable gun 232 will be placed in flow communication with the pneumatic system 216 of the primary gun 212.

The abutment 270 preferably includes a spring loaded post 280 which bears against a corresponding indentation or recess 282 and the upper portion of the first detachable gun 232, in order to help maintain the first detachable gun 232 in the first receiving area 228. Additionally, one or more side tabs 283 may be provided to further stabilize the first detachable gun 232 in the first receiving area 228.

As can be seen in FIGS. 15 and 17, when the first detachable gun 232 is disposed in the first receiving area 228, the actuator 246 of the first detachable gun 232 is aligned with the actuator 248 of the primary gun 212. The actuator 246 is operatively connected with a valve 284, which in turn is in flow communication with the pneumatic system 236 of the first detachable gun 232. The actuator 248 of the primary gun 212 is connected to a sliding plate 286. The sliding plate 286 in turn is connected to the second trigger 224 by a rod 288. Accordingly, by pulling the second trigger 224 toward the left when viewing FIG. 15, the trigger 224 pivots about a pivot point 224*a*, which in turn shifts the plate 286 and the attached actuator 248 downwardly. In turn, the actuator 248 presses on the actuator 246, thus opening the valve 284. As will be explained in greater detail below, when the valve 284 is opened, the first detachable gun 232 is fired as long as the detachable gun 232 has been suitably pressurized.

Figure 20:
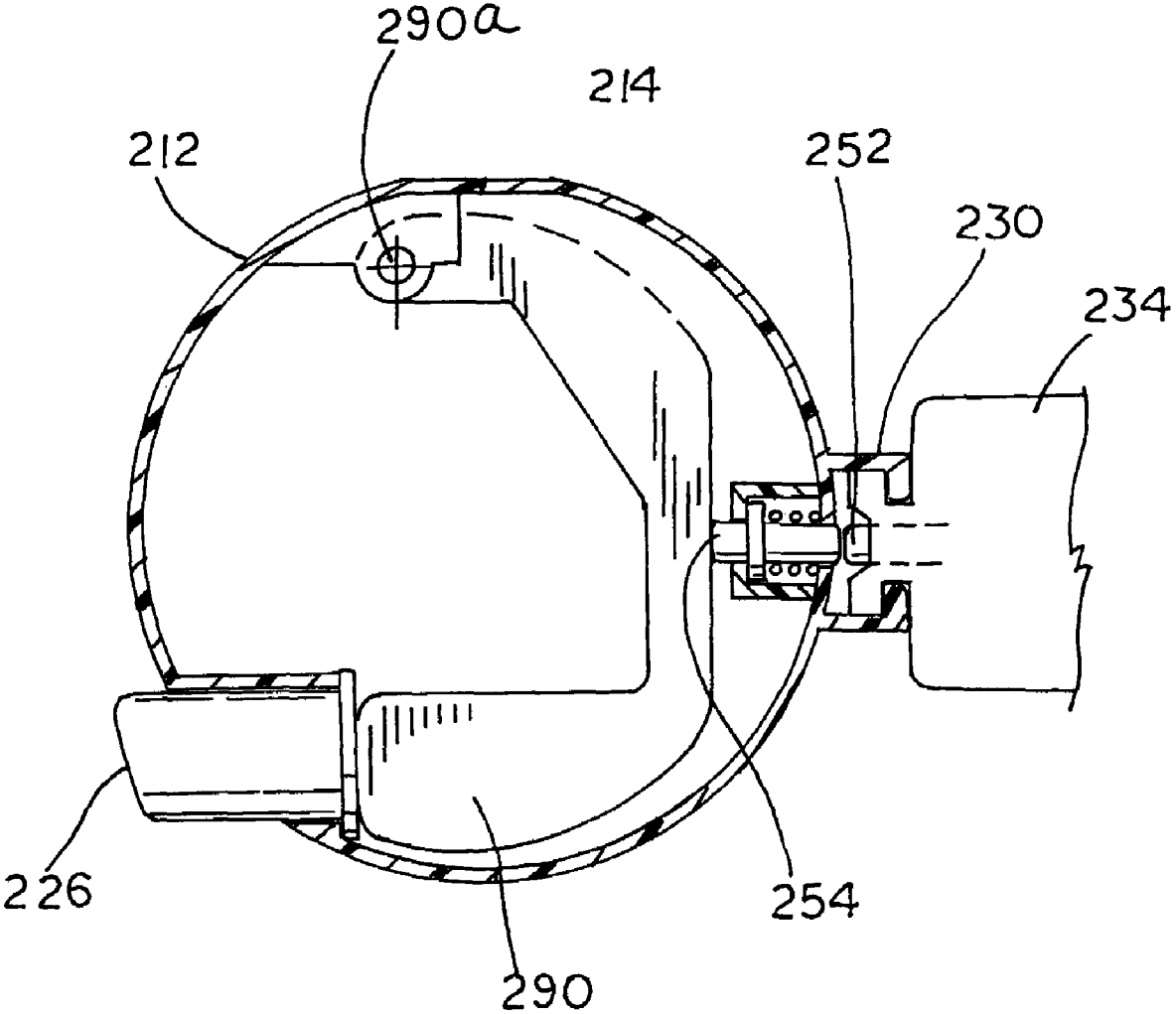
FIG. 20 is an enlarged fragmentary cross-sectional view taken along the line 20-20 of FIG. 17.
Figure 21:
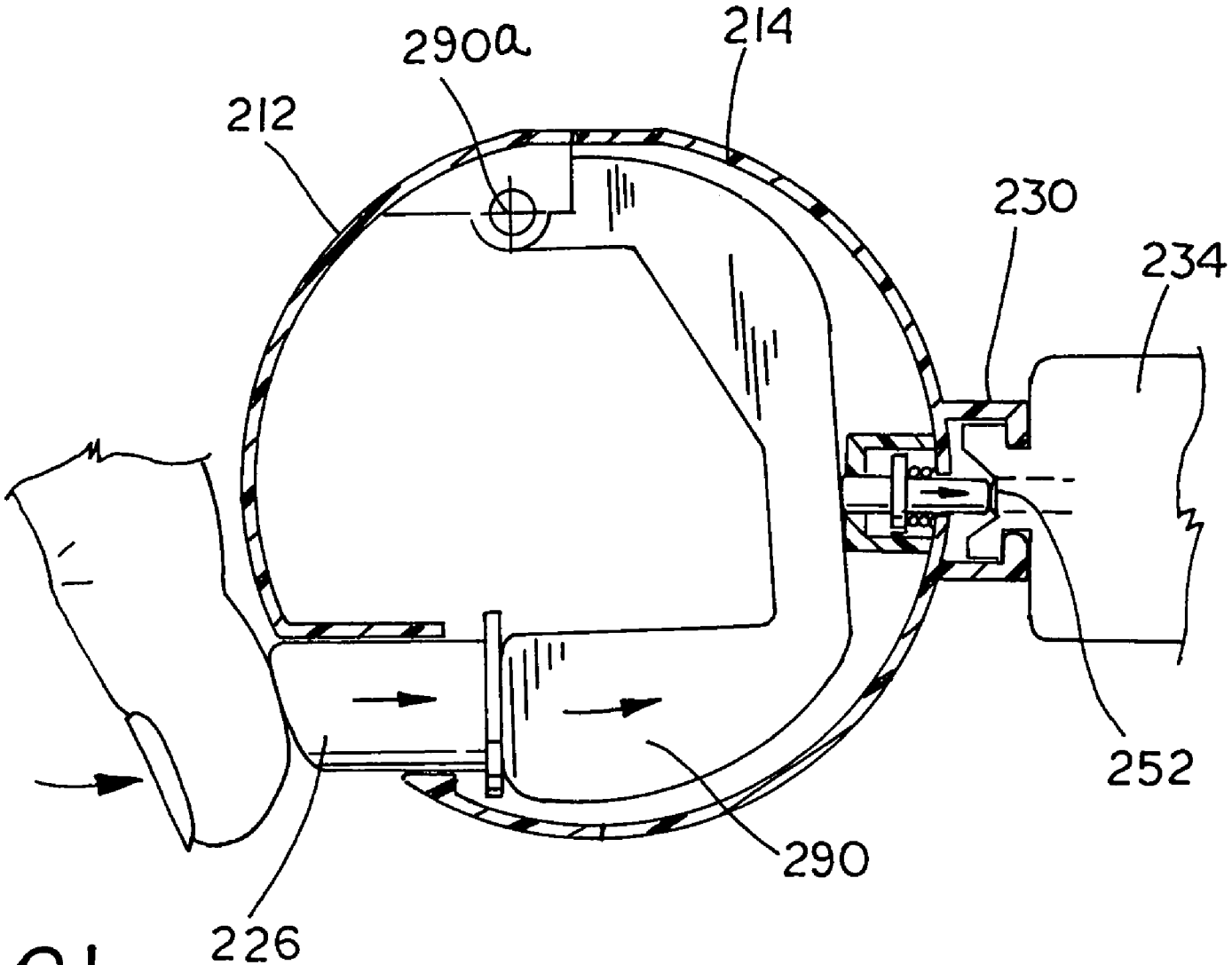
FIG. 21 is an enlarged fragmentary cross-sectional view similar to FIG. 18 and illustrating an actuating trigger on the primary gun shifted to actuate the second detachable gun.

Referring now to FIGS. 20 and 21, the actuator 254 of the primary gun 212 is mounted to or engaged by a lever 290 pivotally mounted inside the housing 214 of the primary gun 212. The lever 290 pivots about a pivot point 290*a*, and a portion of the lever 290 protrudes from the housing 214 of the primary gun 212 to form the third trigger 226. When the third trigger 226 is operated by pushing the third trigger 226 toward the right when viewing FIGS. 20 and 21, the lever 290 pivots about the pivot point 290*a*, which causes the actuator 254 to shift toward the right, which in turn shifts the actuator 252 of the second detachable gun 234. Preferably, the actuator 254 is spring-loaded, such that the trigger 226 is normally biased toward the left when viewing FIGS. 20 and 21. Also, the actuator 252 is preferably spring-loaded, as shown in FIGS. 22-25.

Referring now to FIGS. 22-24, the launching system 238 of the second detachable gun 234 is shown in greater detail. The launching system 238 includes a spring biased plunger 292 which, in the disclosed example, is slidably mounted over a hollow tube 293. An outer housing 294 is slidably mounted to a main body 296 of the second detachable gun 234. The plunger 292 is sized such that it generally provides a seal over the outer surface of the hollow tube 293, such that when the plunger 292 advances under the force of the spring 292*a*, a rear wall 295 of the plunger 292 compresses any air contained within the hollow tube 293. The plunger 292 is slidably mounted within the main body 296, and is configured to launch the projectile C from the launch station 242 by generating a blast of air as the plunger 292 advances under the force of the spring 292*a*.

In the illustrated embodiment, the main body 296 may be configured in the shape of a pistol including a grip 296*a* and finger guard opening 296*b* that may be grasped by a user in a manner allowing the user to pull the main trigger 250 to fire the second detachable gun 234. Both of the trigger 250 and the actuator 252 may be configured to actuate the launching system 238 of the second detachable gun 234. More specifically, the second detachable gun 234 may be fired using the trigger 250 when the second detachable gun 234 is either attached to or separated from the primary gun 212. On the other hand, the second detachable gun 234 may be fired using the third trigger 226 via the actuators 252 and 254 when the second detachable gun is attached to the second receiving area 230.

The forward portion of the main body 296 includes the launch station 242, with the launch station 242 being adapted to receive the projectile C or other appropriate projectile in preparation for firing the second detachable gun 234. The main body 296 may further include one more reserve slots 297 configured to receive extra projectiles for storage prior to loading a selected one of the projectiles C into the launch station 242.

The outer housing 294 may be operatively connected to the plunger 292 of the launching system 238, such that when the outer housing 294 is drawn rearward relative to the main body (or, for example, by pushing the main body forward relative to the outer housing 294 when the second detachable gun 234 is secured to the second receiving area 230 as shown in FIG. 23), the outer housing 294 moves the plunger 292 to a cocked position in preparation for discharging the projectile C.

More specifically, the plunger 292 includes a catch 295*a* and an abutment 295*b*. A pin 295*c* extends transversely through the main body 296 (i.e., the pin 295*c* extends through the plane of the Figure). The main body 296 includes a slot 296*a* (shown in FIGS. 23 and 24), while the ends of the pin 295*c* are suitably secured to the outer housing 294. A spring 297 is connected between main body 296 and the pin 295*c*, which effectively biases the outer housing 294 forwardly relative to the main body 296. Consequently, when the outer housing 294 is shifted rearwardly relative to the main body 296, the pin 295*c* bears against the catch abutment 295*b* of the plunger 292, thus shifting the plunger 292 from the forward position shown in FIG. 22 toward the rearward position of FIG. 23.

In the position of FIG. 23, a catch 300 operatively coupled to the main trigger 250 engages the catch 295*a*, thus retaining the plunger 292 in the position of FIG. 23 with the spring 292*a* compressed. The outer housing 294, assisted by the spring 297, may then be shifted forwardly relative to the main body 296 to the position of FIG. 24. The pin 295*c* is free to travel forwardly along the slot 296*a*. The plunger 292 is retained in the loaded position by virtue of the catch 300 engaging the catch 295*a*.

The catch 300 is carried by a spring biased pivot plate 302 and, in the disclosed example, takes the shape of a ring 304 that fits around the cylindrical plunger 292. Preferably, the ring 304 is slightly oblong vertically, such that the ring 304 surrounds the plunger 292 but is free to shift vertically relative to the plunger 292. A lower edge of the ring 304 forms the catch 300, and the catch 300 bears against the catch 295*a* when the ring 304 is biased upwardly and when the plunger 292 is disposed in the rearward, cocked position of FIG. 23.

The trigger 250 of the second detachable gun 234 is slidably mounted within the main body 296, and may be guided by a pin 306 disposed in a slot 308 carried by the trigger 250. The pivot plate 302 pivots about a pivot point 302*a*, and a lower portion 310 of the pivot plate 302 bears against a sloping upper portion 312 of the trigger 250. A forward portion 314 of the pivot plate 302 is connected to the lower part of the ring 304. Consequently, when the trigger 250 is actuated by moving the trigger 250 toward the left when viewing FIG. 23, the sloping upper portion 312 cams against the lower portion 310 of the plate 302, which causes the forward portion 314 two pull the ring 304 downwardly when viewing the Figure. The downward movement of the ring 304 lowers the catch 300 enough to bring the catch 300 of engagement with the catch 295*a* such that, if the plunger 292 is in the cocked position, the plunger 292 is free to advance under the force of the spring 292*a*.

The actuator 252 is preferably spring-loaded in the outer housing 294 so as to be biased in the upward direction when viewing FIGS. 22-25. An upper part 305 of the ring 304 extends through, or is otherwise accessible through, an aperture 307 in the upper part of the main body 296, such that the actuator 252 is positioned to engage the upper part 305 of the ring 304 when the outer housing 294 and the main body are positioned as shown in FIGS. 22 and 24. Further, the upper part 305 of the ring 304 does not interfere with the relative sliding movement of the outer housing 294 and the main body 296. When the plunger 292 of the second detachable gun 234 is in the cocked position of FIG. 23, the second detachable gun 234 may be fired by pressing on the actuator 252 (such as by using the third trigger 226), which lowers the ring 304, thus lowering the catch 300 out of engagement with the catch 295*a*, such that the plunger 292 is free to advance under the force of the spring 292*a*. Thus, it will be appreciated that the second detachable gun 234 may be fired using either the trigger 250, or the trigger 226 carried by the primary gun 212.

A further description of the second detachable gun 234 may be found in co-pending and commonly assigned U.S. patent application Ser. No. 10/945,795. It will be appreciated that the second detachable gun 234 as described herein and in the above-identified co-pending application is merely exemplary. Other guns may be adapted in accordance with the teachings of the present invention so as to be attachable to and detachable from the primary gun, as well as to be fired from a primary gun or fired independently of the primary gun.

Figure 27:
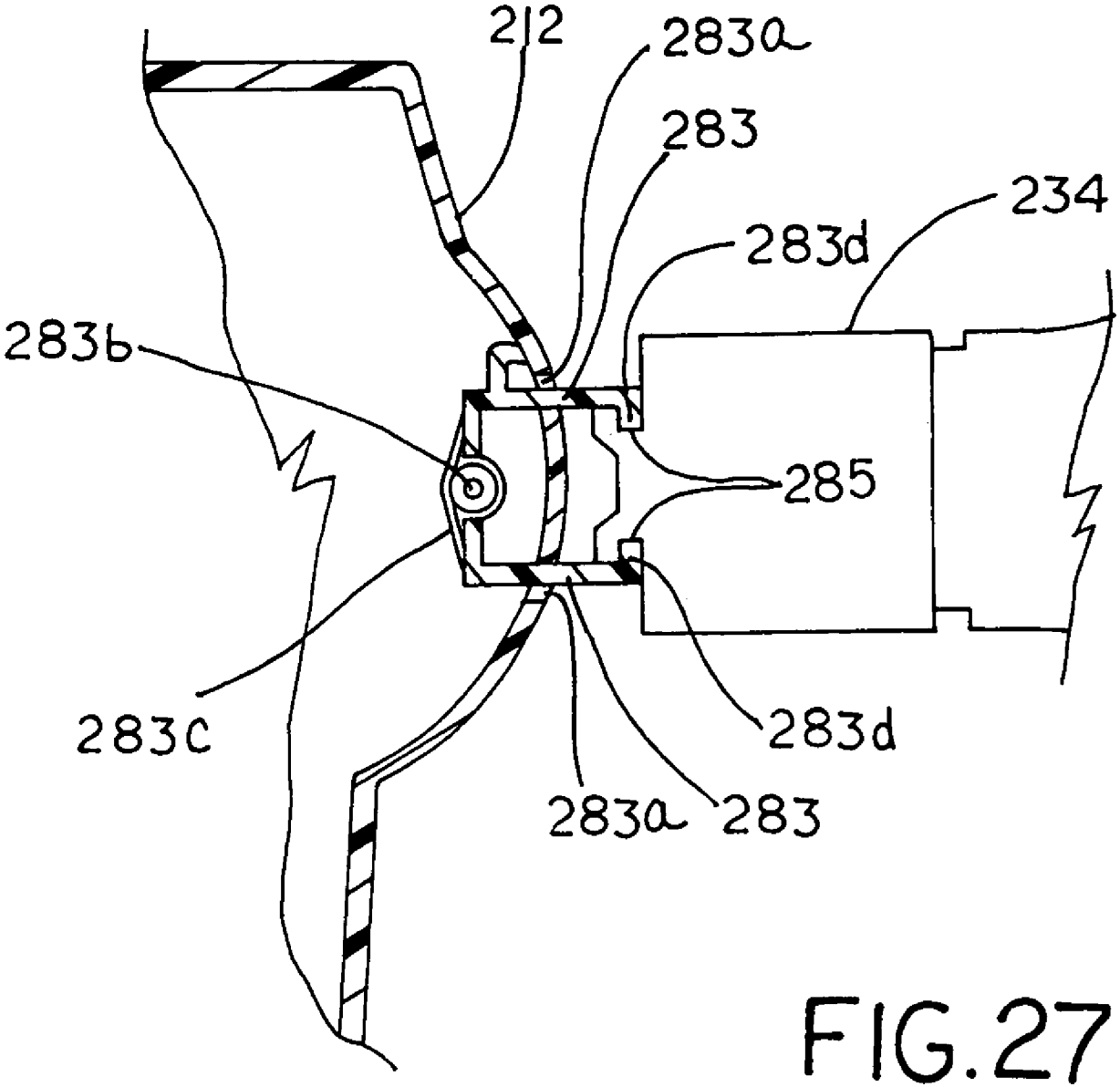
FIG. 27 is an enlarged fragmentary cross-sectional view taken along line 27-27 of FIG. 25 and illustrating the second detachable gun attached to the primary gun.

Referring now to FIG. 27, the second receiving area 230 is shown. The tabs 283 extend through suitably sized slots 283*a* in the housing 212. The tabs 283 pivot about a pivot point 283*b*, and a spring 283*c* biases the ends 283*d* of the tabs 283 toward one another. Accordingly, the tabs 283 form a track, and apply a frictional retaining force to suitably sized slots 285 formed on the second detachable gun 234. Conveniently, the first receiving area 228 may be provided with a similar or identical structure to that shown in FIG. 27, with the first detachable gun 232 also including suitably sized slots to receive the ends 283*d* of the spring-biased tabs 283. For the sake of brevity, the same structure need not be described in detail.

Figure 28:
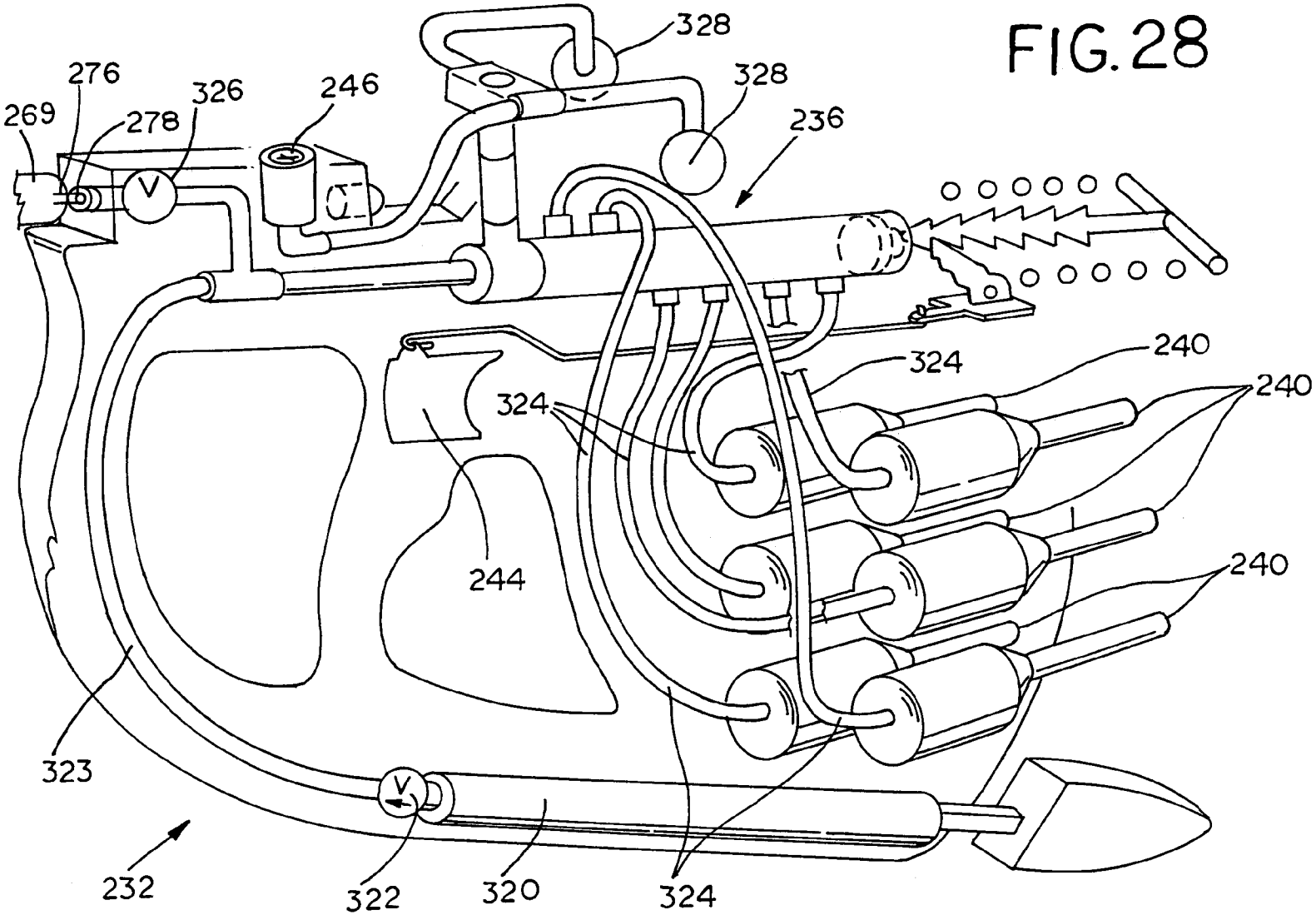
FIG. 28 is an enlarged schematic view in perspective of the pneumatic system of the first detachable gun.

Referring now to FIG. 28, the pneumatic system 236 of the first detachable gun 232 includes a reciprocating pump 320 arranged to pressurize at least a portion of the pneumatic system 236, a one-way valve 322, and a conduit 323. Each of the launch stations 240 is connected to the pneumatic system 236 via a suitable conduit 324. A one-way valve 326 may be disposed generally adjacent to the port 278. A pair of actuating buttons 328 are provided on the sides of the first detachable gun 232. It will be appreciated that the pneumatic system 236 of the first detachable gun 232 may be pressurized using the pump 320, or the pump 218 of the primary gun 212 when the first detachable gun 232 is disposed in the first receiving area 228. The pneumatic system 236 of the first detachable gun 232 may be similar to that disclosed in U.S. Pat. No. 5,592,931, entitled Compressed Air Gun With Magazine Indexer, issued Jan. 14, 1997, the entire disclosure of which is incorporated herein by reference. Alternatively, other suitable pneumatic launching systems of the type commonly employed in the art may be used. Another example of a suitable air-operated toy gun having a pneumatic launching systems is known and was sold under the trade name BLASTFIRE®.

It will be appreciated that, when of the pneumatic system 236 of the first detachable gun 232 is suitably pressurized as described above, the projectiles disposed in the launch stations 240 may be launched simply by actuating the second trigger 224 on the primary gun 212, which launches the projectiles by moving the actuator 246. Similarly, the projectiles may be launched from the launch stations 240 by operating one of the actuators 328 on the first detachable gun 232. Finally, the actuators may be launched by using the trigger 244 on the first detachable gun 232.

By using the teachings of the above-identified U.S. Pat. No. 5,592,931, or by using the teachings of the above-identified BLASTFIRE® toy, one of skill in the art can readily make the first detachable gun 232 capable of firing projectiles using either its own trigger 244, the actuators 328, or the actuator 246. In accordance with the disclosed example, when the first detachable gun 232 is actuated using either the actuator 246 via operation of the second trigger 224, or using the actuators 328, all of the projectiles B in the launch stations 240 may be launched simultaneously. Further, using the teachings of the BLASTFIRE® toy, one of skill in the art can readily adapt the first detachable gun 232 so as to be capable of firing the projectiles one at the time.

The preceding text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

What is claimed is:

1. A toy gun system for launching projectiles and comprising:

a primary gun having a pneumatic system, a launch station in flow communication with the pneumatic system, and first, second and third triggers, the primary gun adapted to launch a projectile from the launch station in response to actuation of the first trigger;

the primary gun further including a first receiving area having an output port and a valve in flow communication with the pneumatic system, the first receiving area having a first shiftable actuator responsive to movement of the second trigger;

the primary gun further including a second receiving area, the second receiving area having a second shiftable actuator responsive to movement of the third trigger;

a first detachable gun having a launch station and sized for mounting to the first receiving area, the first detachable gun having a pneumatic system arranged to receive pressurized air from the pneumatic system of the primary gun via the output port of the first receiving area, the first detachable gun adapted to launch a projectile from the launch station in response to actuation of the second trigger when the first detachable gun is disposed in the first receiving area; and a second detachable gun sized for mounting to the second receiving area, the second detachable gun having a launching system adapted to launch a projectile from a launch station in response to operation of the third trigger; and wherein the first and second detachable guns are selectively removable from the first gun for use.

2. The toy gun system of claim 1, wherein the first detachable gun includes a main trigger, and wherein the first detachable gun is operable using either of the second trigger or the main trigger.

3. The toy gun system of claim 1, wherein the second detachable gun includes a main trigger, and wherein the second detachable gun is operable using either of the third trigger or the main trigger.

4. The toy gun system of claim 1, wherein the first receiving area includes a spring-loaded retainer positioned to releasably retain the first detachable gun in the first receiving area.

5. The toy gun system of claim 1, wherein the pneumatic system of the primary gun includes a first conduit having a valve, the valve shiftable between an open position when the first detachable gun is disposed in the first receiving area to permit flow communication between the pneumatic system of the primary gun and the pneumatic system of the first detachable gun, the valve shiftable to a closed position in response to removing the first detachable gun from the first receiving area.

6. The toy gun system of claim 1, wherein the primary gun includes a track and a portion of the second detachable gun is sized to engage the track.

7. The toy gun system of claim 1, wherein the second detachable gun is attached to the second receiving area by a sliding track connection, and wherein the sliding track connection includes a stop.

8. The toy gun system of claim 7, wherein the second detachable gun includes a housing forming part of the slide track connection, the housing shiftable relative to a body of the second detachable gun, the second detachable gun further including a spring-loaded plunger operably coupled to the housing, the plunger shiftable between an uncocked position and a cocked position in response to shifting the housing relative to the body of the second detachable gun.

9. The toy gun system of claim 1, wherein the pneumatic systems of each of the primary gun and the first detachable gun includes a pump, and wherein the pneumatic system of the second detachable gun is arranged to be pressurized using the pump of the primary gun or the pump of the first detachable gun.

10. The toy gun system of claim 1, wherein the first detachable gun includes a plurality of launch stations, and wherein the first detachable gun is operable in a first mode in which only a single launch station is actuated at a time, the first detachable gun further operable in a second mode in which more than one of the launch stations are actuated at once.

11. A toy gun system comprising:

a primary gun having a pneumatic system including a reservoir, a launch station in flow communication with the reservoir, a plurality of actuating triggers, a valve disposed operatively associated with the launch station and responsive to actuation of a first one of the triggers, the primary gun adapted to launch a projectile from the launch station in response to actuation of the first trigger;

the primary gun further including at least one receiving area, the receiving area having an output port and a valve in flow communication with the pneumatic system, the receiving area positioned on the primary gun adjacent a first shiftable actuator responsive to movement of a second one of the triggers;

a first detachable gun having a launch station and sized for mounting to the first receiving area, the first detachable gun having a pneumatic system arranged for flow communication with the pneumatic system of the primary gun via the output port when the first detachable gun is disposed in the receiving area, the first detachable gun adapted to launch a projectile from the launch station of the first detachable gun in response to actuation of the second trigger when the first detachable gun is disposed in the first receiving area, the first detachable gun further including a main trigger and adapted to alternatively launch a projectile from the launch station of the first detachable gun in response to actuation of the main trigger.

12. The toy gun system of claim 11, wherein the primary gun includes a second receiving area positioned on the primary gun adjacent a second shiftable actuator responsive to movement of a third one of the triggers; and a second detachable gun sized for mounting to the second receiving area and including a main trigger, the second detachable gun having a launching system adapted to launch a projectile from a launch station in response to operation of the third trigger when the second detachable gun is disposed in the second receiving area or in response to actuation of the main trigger of the second detachable gun.

13. The toy gun system of claim 11, wherein the first receiving area includes a spring-loaded plunger positioned to releasably retain the first detachable gun in the first receiving area.

14. The toy gun system of claim 11, including a valve shiftable between an open position when the first detachable gun is disposed in the first receiving area to permit flow communication between the pneumatic system of the primary gun and the pneumatic system of the first detachable gun, the valve automatically shiftable to a closed position in response to removing the first detachable gun from the first receiving area.

15. The toy gun system of claim 11, wherein the primary gun includes a track and a portion of the second detachable gun is sized to engage the track.

16. The toy gun system of claim 11, wherein the second detachable gun is attached to the second receiving area by a sliding track connection, and wherein the second detachable gun forms part of the sliding track connection, the housing of the second detachable gun shiftable relative to a body of the second detachable gun, the second detachable gun further including a spring-loaded plunger operably coupled to the housing, the plunger shiftable between an uncocked position and a cocked position in response to shifting the housing relative to the body of the second detachable gun.

17. The toy gun system of claim 11, wherein the pneumatic systems of each of the primary gun and the first detachable gun includes a pump, and wherein the pneumatic system of the second detachable gun is arranged to be pressurized using the pump of the primary gun or the pump of the first detachable gun.

18. The toy gun system of claim 11, wherein the first detachable gun includes a plurality of launch stations, and wherein the first detachable gun is operable in a first mode in which only a single launch station is actuated at a time, the first detachable gun further operable in a second mode in which more than one of the launch stations are actuated at a time.

19. A toy gun system comprising:

a primary toy gun having a pressurizable reservoir, a launch station in flow communication with the reservoir, an actuating trigger, and an actuator arranged to release pressure from the reservoir through the launch station, the launch station adapted to hold and release a foam projectile in response to actuation of the actuator;

the primary toy gun further including a receiving area, the receiving area having an output port, the output port of the receiving area in flow communication with the reservoir;

a detachable toy gun removably attached to the first receiving area, the detachable toy gun including a pressurizable reservoir, a launch station in flow communication with the reservoir, and an actuator arranged to release pressure from the reservoir through the launch station to launch a foam projectile, the detachable toy gun including an input port arranged to route pressure from the output port of the receiving area to the reservoir of the detachable toy gun; and wherein the detachable toy is selectively operable to launch the foam projectile when the detachable toy is in the receiving area and when the detachable toy is removed from the receiving area.

20. The toy gun system of claim 19, including a valve positioned to control flow into the input port of the detachable toy gun.

21. The toy gun system of claim 19, including a one-way valve positioned to control flow between the primary gun and the detachable toy gun.

22. The toy gun system of claim 21, wherein the one-way valve opens in response to an increase in air pressure in the reservoir of the primary toy gun.

23. The toy gun system of claim 19, including a spring-loaded retainer positioned to bias at least a portion of the detachable toy into engagement with the first receiving area and to permit flow communication between the reservoir of the primary toy gun and the detachable toy gun when the detachable toy gun is in the receiving area.

* * * * *